US008410923B2

(12) United States Patent
Wang et al.

(10) Patent No.: US 8,410,923 B2
(45) Date of Patent: Apr. 2, 2013

(54) SINGLE MCU-BASED MOTION DETECTION, LOCAL ALARM AND SUPERVISORY ARRANGEMENT FOR ALARM SYSTEM

(76) Inventors: Randall Wang, Temple City, CA (US); James Parker, Temple City, CA (US)

( * ) Notice: Subject to any disclaimer, the term of this patent is extended or adjusted under 35 U.S.C. 154(b) by 458 days.

(21) Appl. No.: 12/592,481

(22) Filed: Nov. 25, 2009

(65) Prior Publication Data

US 2010/0219949 A1 Sep. 2, 2010

Related U.S. Application Data

(60) Provisional application No. 61/117,931, filed on Nov. 25, 2008.

(51) Int. Cl.
*G08B 13/00* (2006.01)

(52) U.S. Cl. ..... 340/539.1; 340/541; 340/565

(58) Field of Classification Search ..... 340/545.3, 340/565, 567, 506, 541, 573.1, 556, 522
See application file for complete search history.

(56) References Cited

U.S. PATENT DOCUMENTS 4,808,972 A * 2/1989 Nicholls ..... 340/541
5,192,931 A * 3/1993 Smith et al. ..... 340/550
5,742,231 A * 4/1998 Kolodin ..... 340/541
5,886,622 A * 3/1999 Snyder ..... 340/426.26
6,118,375 A * 9/2000 Duncan ..... 340/541
7,535,351 B2 * 5/2009 Reymond ..... 340/541
7,564,350 B2 * 7/2009 Boman et al. ..... 340/545.6
7,589,626 B2 * 9/2009 Hane ..... 340/539.1
7,994,911 B2 * 8/2011 Mercier et al. ..... 340/541
2004/0012493 A1 * 1/2004 Park ..... 340/545.1
2005/0237182 A1 * 10/2005 Wang ..... 340/539.1
2007/0114414 A1 * 5/2007 Parker et al. ..... 250/338.3

* cited by examiner

*Primary Examiner* — Daniel Wu
*Assistant Examiner* — Mohamed Barakat
(74) *Attorney, Agent, or Firm* — Raymond Y. Chan; David and Raymond Patent Firm

(57) ABSTRACT

A device with single MCU-based motion detection, local alarm and supervisory arrangement for alarm system controlled by an alarm control panel (ACP) is disclosed. The device includes a sensor component to monitor environment, an output component to generate warning messages, a power supply component to provide power, and a microcontroller to communicate with sensor component, drive output component and monitor the status of ACP. The device can detect when intruders break in and make alarm warnings even when the ACP is destroyed. Plurality of devices and said ACP form a local warning matrix network (LWMN) to increase the detection area and scary effect to intruders. Each device of LWMN works independently when the ACP is destroyed.

33 Claims, 30 Drawing Sheets

Two Sample Windows (1000-2000 & 4000-5000)

SINGLE MCU-BASED MOTION DETECTION, LOCAL ALARM AND SUPERVISORY ARRANGEMENT FOR ALARM SYSTEM

CROSS-REFERENCE TO RELATED APPLICATIONS

This is a non-provisional application for its provisional application filed on Nov. 25, 2008. The provisional application number is 61/117,931.

BACKGROUND OF THE PRESENT INVENTION

1. Field of Invention

The present invention relates to Passive Infrared Radiation (PIR) motion detector and more particularly to a motion detection system with local alarm warning function and supervisory function for alarm system.

2. Description of Related Arts

A typical security alarm system consists of an alarm control panel (ACP), motion detectors, smoke detector, other security sensors, audible and voice warning devices, etc. ACP is a unit where the detection devices and wiring of the alarm are connected and managed. ACP provides power and sends operating information to the detectors and other devices. Also, ACP can integrate with wireless transmitter and receiver to communicate with the detectors and other devices. Since all appliances of the alarm system demand on the power output of the control panel, if an intruder quickly and purposely destroys the control panel to lose its power, the whole alarm system is useless no matter how intelligent the alarm system is.

U.S. Pat. Nos. 5,654,691 and 6,011,465 successfully solve the above problems by suggesting a backup device of alarm system which can monitor the conditions of the ACP such as power output, normal function, and communication. However, motion detectors in an alarm system will not work in an event of a control panel is destroyed. If an intruder waits until the audible/voice warning device goes off after the control panel is destroyed and returns back, there will be no intrusion detection and no local alarm warning. There is lack of a device which has motion detection, local alarm warning and supervisory function combined together for an enhanced alarm system with back up function

SUMMARY OF THE PRESENT INVENTION

A main object of the present invention is to provide a device that has motion detection, backup power supply, local alarm warning, and supervisory function.

Another object of the present invention is to provide a device that detects when intruders break in and triggers the alarm systems to make alarm warning via the built-in alarm warning component.

Another object of the present invention is to provide a device having real-time monitoring and supervising function for the alarm system.

Another object of the present invention is to provide a device that can work together with other units of the device to provide multi-point alarm warnings to extremely enhance the overall protection and deterrent effect.

Another object of the present invention is to provide a device that can work as a stand alone local alarm to detect motion and give local alarm warning after an associated ACP is fully destroyed.

Another object of the present invention is to provide a device that can be installed as easy as installing traditional/standard motion or other detectors.

Accordingly, in order to accomplish the above objects, the present invention provides a device that applied in an alarm system comprises the following steps.

(A) check the AUX Power of ACP;

(B) If the ACP is destroyed, generate loud sound and visual alarm alerts simultaneously for the period of a preset cutoff time (such as 3 minutes) to form multi-point alarms if multiple units of device 10 are used. (The backup battery 30 will provide all power needed for the device 10 including its audio and visual modules.); and (C) generate loud sound and visual alarm alerts simultaneously for a preset time (such as 3 minutes) for every movement detected by the device 10 till the backup battery is drained out The device with single MCU-based motion detection, local alarm and supervisory arrangement, comprising:

a sensor component monitoring the condition of the environment and the system to generate reference information;

a microcontroller monitoring the condition of the power input from said ACP, receiving reference information from said sensor component, controlling the operation of said back up power supply, and driving said output component;

a power supply component providing power for the operation of the device;

an output component communicating between the microcontroller and ACP and sends warning messages;

The present invention will be better understood from the following detailed description of preferred embodiments of the present invention and accompanying drawings.

DETAILED DESCRIPTION OF THE PREFERRED EMBODIMENTS

Referring to FIG. 1 to FIG. 24 of the drawings, the present invention provides a device with motion detection, local alarm warning and supervisory function combined together for alarm systems.

Figure 1:
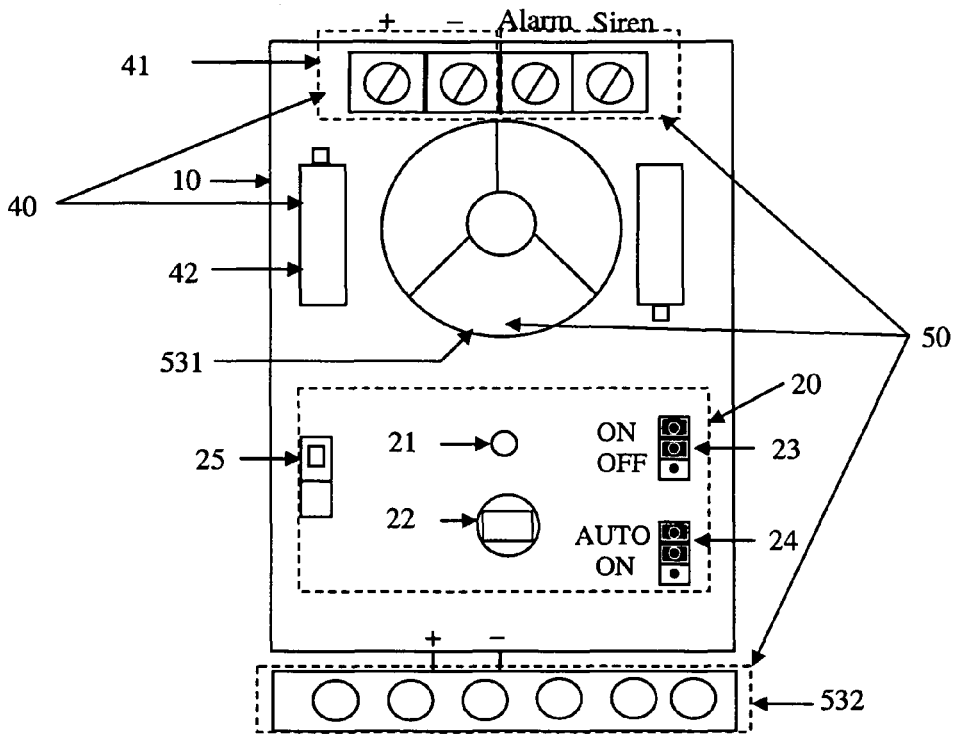
FIG. 1 is a front view illustration of the device with motion detection, local alarm warning and supervisory function combined together for alarm system according to a preferred embodiment of the present invention.
Figure 2:
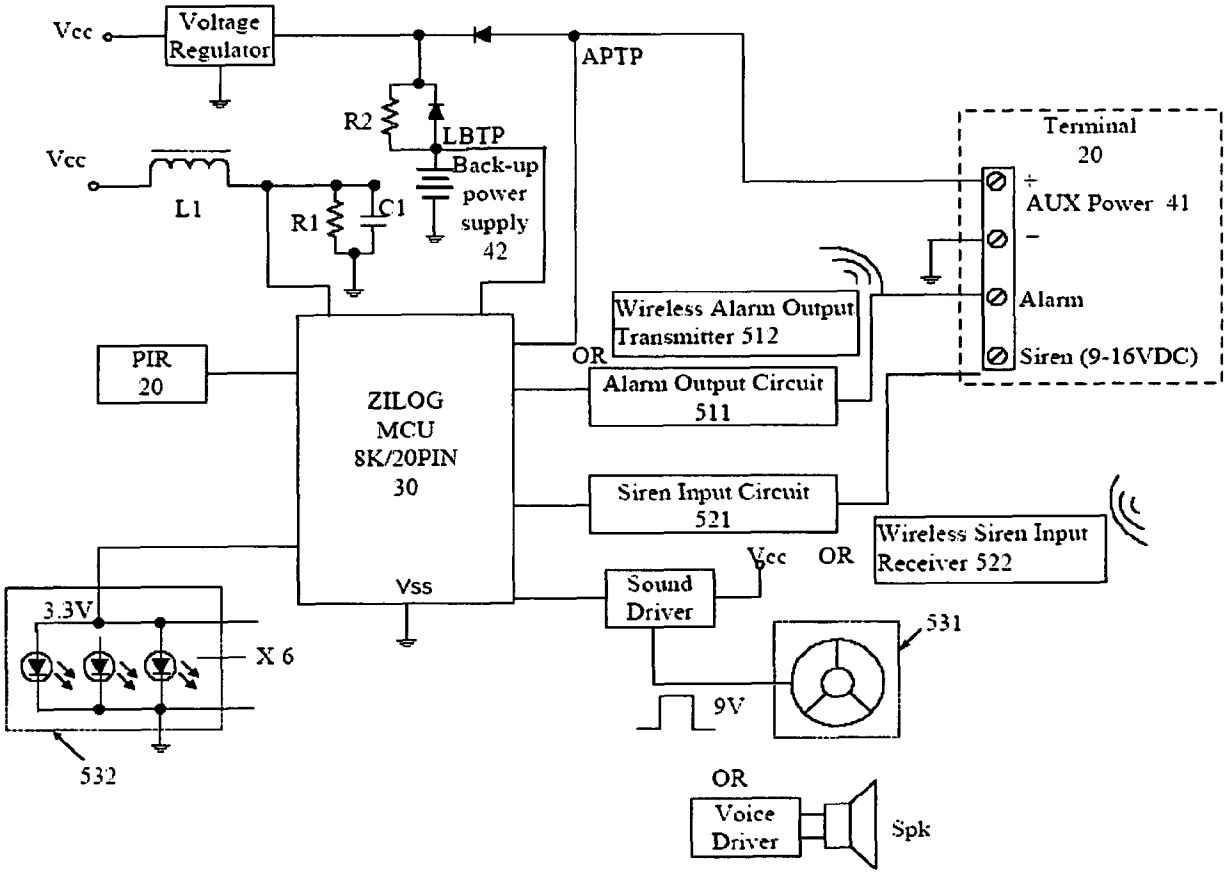
FIG. 2 is a basic layout illustration of the device with motion detection, local alarm warning and supervisory function combined together for alarm system according to the above preferred embodiment of the present invention.

Referring to FIG. 1 and FIG. 2, in a preferred embodiment of the present invention, the device 10 comprises: a sensor component 20 which is monitoring the condition of the environment and the system to generate reference information; a power supply component 40 which provides power for the operation of the device; an output component 50 which enables communication between the microcontroller 30 and the ACP and sends warning messages; a microcontroller 30 which monitors the condition and operation of the power supply component 40, receives reference information from the sensor component 20, and send alarm signals by the output component 50.

According to the present invention, referring to FIG. 1, power supply component 40 comprises an AUX power supply 41 provided by the ACP and a back up power supply 42.

According to the present invention, referring to FIG. 1 and FIG. 2, the output component 50 comprises an alarm output element 51, a siren input element 52, and an alarm warning element 53. The alarm warning component 53 further comprises a siren 531 and a LED matrix 532.

Referring to FIG. 1, a terminal includes four connections: +, −, Alarm, and Siren. The "+" connection connects with the "+" of "AUX power" 41 connection of an ACP to receive power. The "−" connection connects with the "−" of "AUX power" 41 connection of an ACP to receive power. The "Alarm" connection connects with the "ZONE" connection of an ACP to send alarm output signals to the ACP. The "Siren" connection connects with the "+" connection of "Siren" connection of an ACP to receive siren signals from the ACP. It can distinguish and memorize the polarity of the ACP's siren output. After the power is applied to the device 10, a walk test needs to be conducted to check the detection profile, such as detection range, detection angle, etc. The walk test time could be extended by motion.

Back up power supply 42 provides power for the device 10 when a connected ACP is destroyed. Referring to FIG. 1, when the ACP is destroyed, that means the "AUX power" 41 is lost and there is no power provided to the "+" and "−" connections of the terminal. Back up power supply 42 then provides back-up power for the device 10 when the ACP is destroyed.

Figure 18:
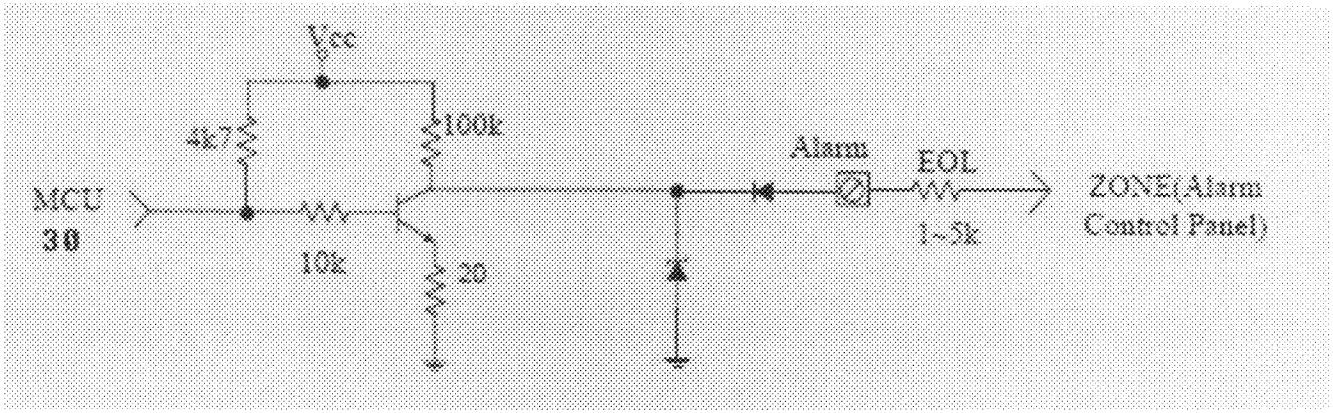
FIG. 18 is a circuit diagram illustrating the alarm output.
Figure 19:
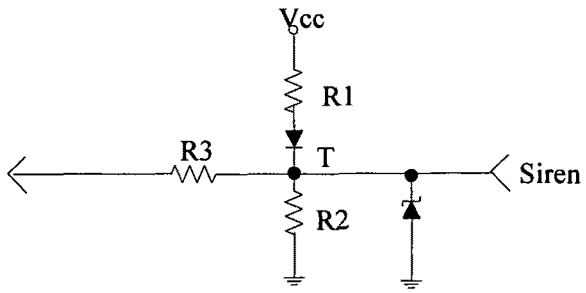
FIG. 19 is a circuit diagram illustrating the siren input.

The alarm output element 51 comprises an alarm output circuit 511 and the siren input element 52 comprises a siren input circuit 521. As shown in FIG. 18 and FIG. 19, the detail of the alarm output circuit 511 and the siren input circuit 521 are illustrated. The alarm output circuit 511 of the device 10 according to the preferred embodiment of the present invention is a single wired solid-state control circuit without using a relay which is commonly required in a traditional PIR motion sensor output to the ZONE connection of an ACP. The siren input circuit 521 of the device 10 according to the preferred embodiment of the present invention is a voltage divider arrangement circuit which connects the signal from the siren connection in the terminal with the microcontroller 30.

Referring to FIG. 2, the communication between the microcontroller 30 and the ACP can be implemented by wireless transmitter and receiver module. The alarm output element 51 can also comprises a wireless alarm output transmitter module 512 and the siren input element 52 comprises a wireless siren input receiver module 522.

Figure 21A:
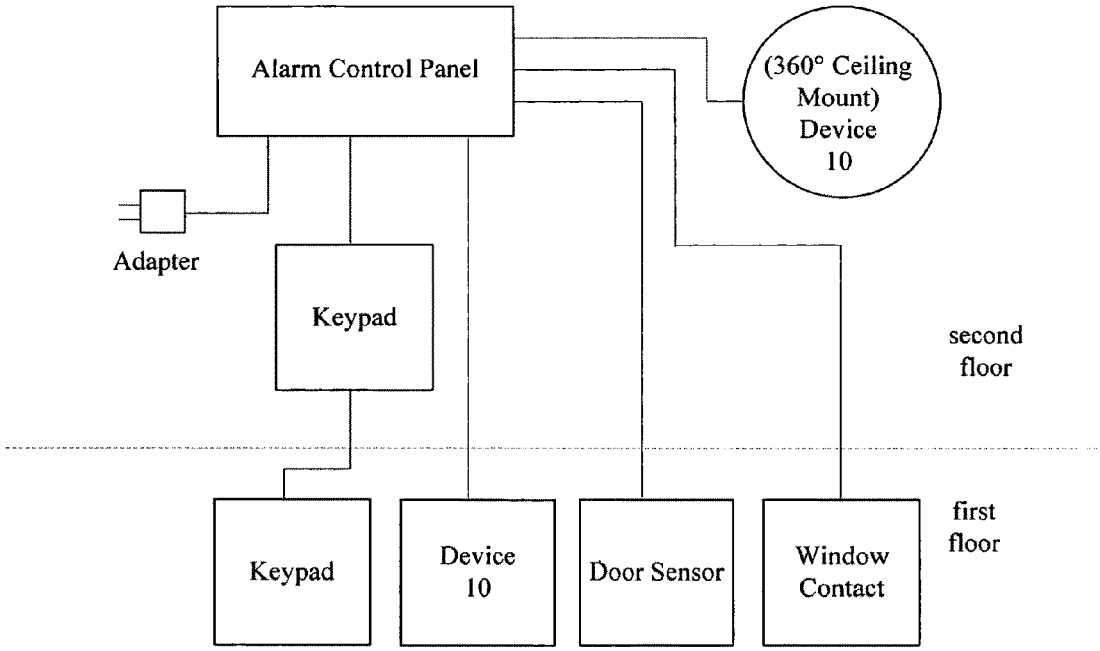
FIG. 21A is an illustration of an application layout in a residential alarm system according to the above preferred embodiment of the present invention.
Figure 21B:
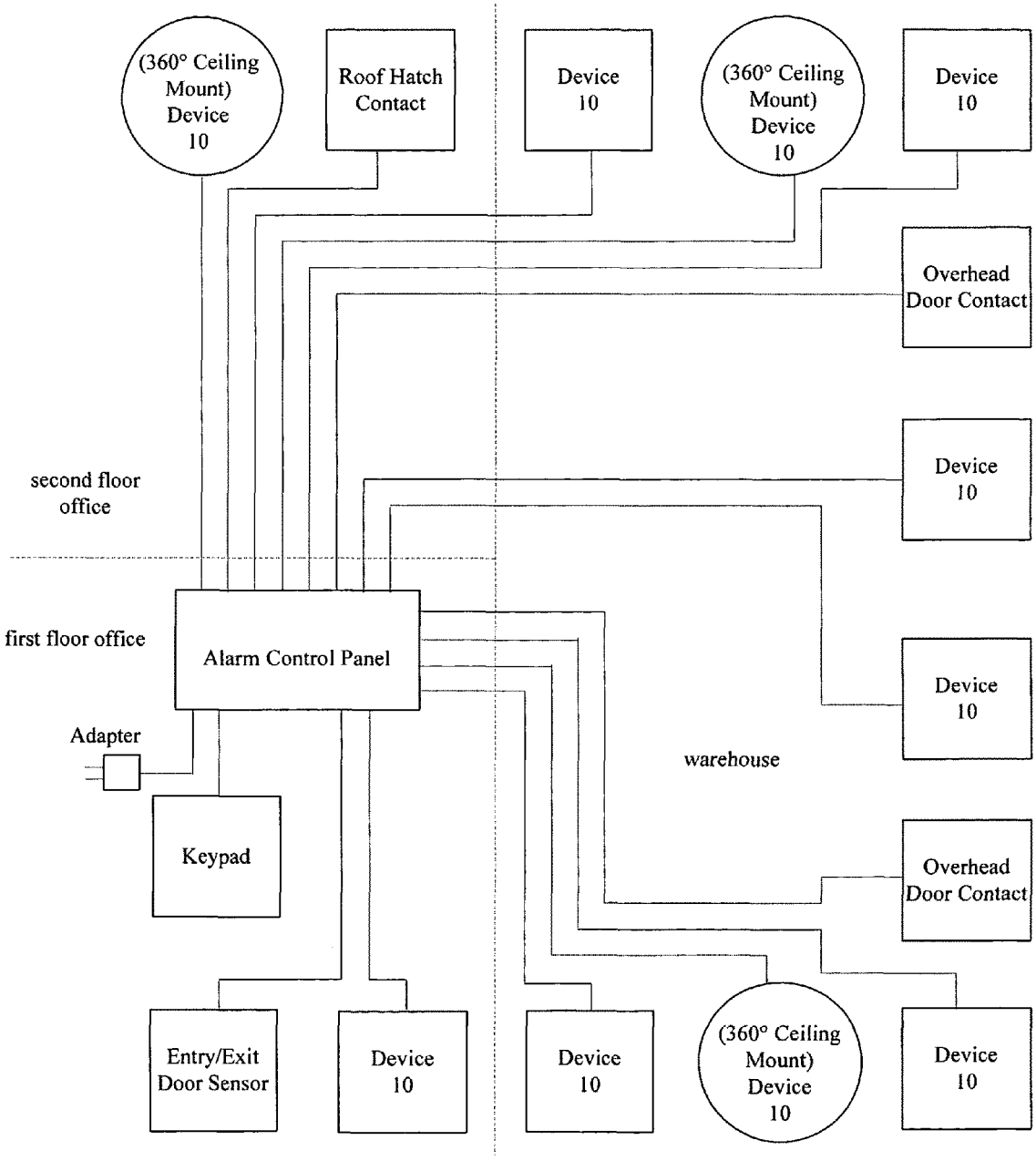
FIG. 21B is an illustration of an application layout in a commercial or industrial alarm system according to the above preferred embodiment of the present invention.

The microcontroller 30 send alarm signal to ACP and receive siren signal from ACP by the wireless communication module. Referring to FIG. 21A and FIG. 21B, when the alarm system comprises multiple devices 10, the devices 10 communicate with each other and with ACP simultaneously by wireless. The wireless module has coding and decoding function that improves the accuracy of signal transmitting and receiving.

The built-in high peak siren 531 which provides audible alarm warning in an alarm condition or when a connected alarm control panel is destroyed. The LED matrix 532 which provides visual alarm warning in an alarm condition or when a connected alarm control panel is destroyed. When the device 10 is in alarm condition or the connected ACP is destroyed, the device 10 will send trigger signal to ACP by the alarm output element 51 and ACP will send siren signal to the device 10 by the siren input element 52. Then the build-in high peak siren 531 will send audible alarm warning message and the LED matrix 532 will flash and send visual warning message to frighten away intruders.

Referring to FIG. 1, the sensor component 20 is a motion detector which detects such as human activities in the detection area. The sensor component 20 further comprises an LED indicator LED 21, an energy (pyro) sensor 22, a pet immunity jumper 23, an auto LED jumper 24, and a tamper switch 25.

The LED indicator 21 indicates motion is detected when the pyro sensor 52 detects movements in the detecting area. In default, the LED indicator 21 will flash when the motion is detected. The LED indicator 21 also can be disabled for different settings of the auto LED jumper 24. A flashlight or laser pointer may be used to disable LED indicator 21 by directly shinning lights on the LED indicator 21 of the device 10 for a period of time within a certain distance. For example, shine lights on the LED indicator 51 of the device 10 for 20-30 seconds within 4 inch distance.

The auto LED jumper 24 is a LED enable or disable jumper. When the auto LED jumper 24 is at ON, the LED indication is enabled. The LED indicator 21 will flash when the motion is detected. When the auto LED jumper 24 is at AUTO, the LED indication will be disabled automatically once the walk test has been finished. Then the LED indicator 51 will not flash when the motion is detected. The advantages of auto LED setting include: increase security levels by not disclosing the detection profile such as detection area, detection angle, dead angle, etc.; reducing the working load The pet immunity jumper 23 sets different weight range for pet immunity. For example, when the pet immunity jumper 23 is at OFF, the immunity to pets is less than 30 lbs. when the pet immunity jumper 23 is at ON, the immunity to pets is up to 65 lbs. The number of pets can be more than one, as long as their total weight is in the range.

The energy sensor 22 is adapted for defining a detecting area and detecting energy directed there within to produce inputted energy signals.

Figure 3:
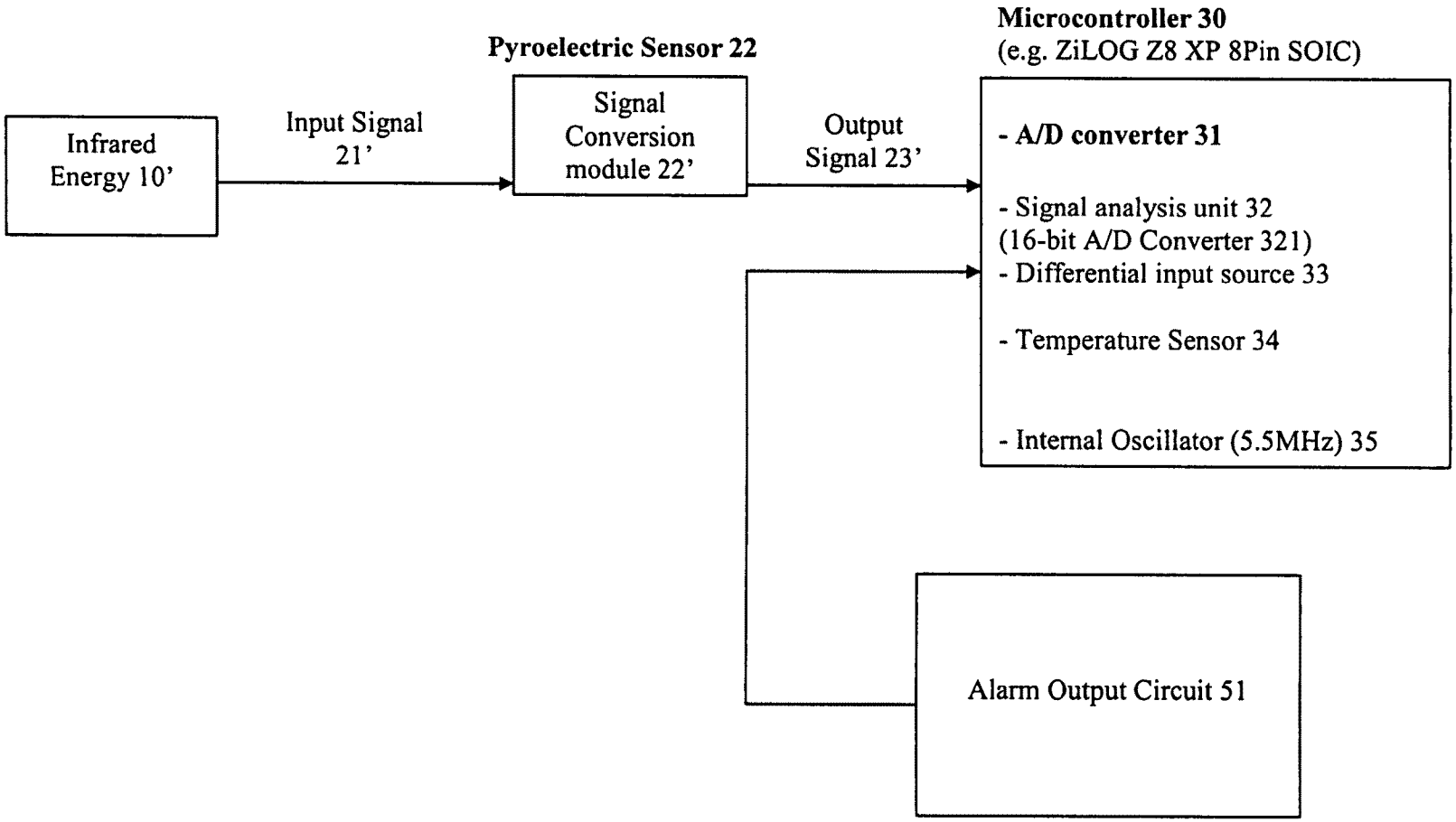
FIG. 3 is a block diagram of a system of energy signal detection according to the above preferred embodiment of the present invention.

Referring to FIG. 3, the present invention utilizes a process and system of motion detection, which improves sensitivity, performance and reliability thereof and reduces false alarms by distinguishing between noise and real signals. The microcontroller 30, which is electrically connected to the energy sensor 22, comprising an analog-to-digital converter (A/D converter or ADC) 31 to convert the inputted energy signals into data samples, wherein a plurality of data samples are averaged to form a predetermined number of constructed sample windows of constructed samples in time, wherein a control range is determined for each of the constructed sample windows, and thus by comparing relationships between the successive constructed sample windows, the microcontroller 30 is capable of determining whether there is an alarm condition.

The alarm output circuit 511 is electrically connected from the microcontroller 30 for changing output stage from restore to alarm for a predetermined period of time when the microcontroller 30 determines the alarm condition.

According to the preferred embodiment of the present invention, the energy signal detection system is embodied as an infrared sensor where the energy sensor is embodied as a pyroelectric sensor 22 which is a pyroelectric sensing element adapted for sensing energy radiation, i.e. the infrared energy 10' according to the preferred embodiment, within a detecting area. The pyroelectric sensor 22 is passive and has two or more detecting elements for detecting energy, wherein a signal will be emitted when a difference exists in the energy being detected between the individual elements.

The infrared energy 10' is directed onto the pyroelectric sensor 22, wherein the infrared radiation 10' as an input signal 21' is converted into an output signal 23' through a signal conversion module 22' of the pyroelectric sensor 22, wherein the output signals 23' generally contain real signals with low frequency and noise signals mixed therewith.

The microcontroller 30 is embodied as an integrated circuit, such as a ZiLOG Z8 XP 8 Pin SOIC, wherein ZiLOG is the manufacturer symbol, Z8 is the product line symbol and XP is the family symbol of the microcontroller. The microcontroller 30 has the A/D converter 31 converting the output signals 23' from the pyroelectric sensor 22 to data samples for data processing.

According to the preferred embodiment of the present invention, a 10 bit sigma delta A/D converter is used. In order to enhance the input resolution of the A/D converter 31, the present invention provides a differential voltage reference internally for the inputted energy signals, referring to FIG. 4 and FIG. 13, wherein the PIN3 of the microcontroller 30 is fed with a voltage reference, VREF, generated from an internal voltage reference generator 321 while the PIN5 of the microcontroller 30 is fed with the output signals 23' from the pyroelectric sensor 22, wherein the lower the voltage reference VREF provides more resolution.

Figure 4:
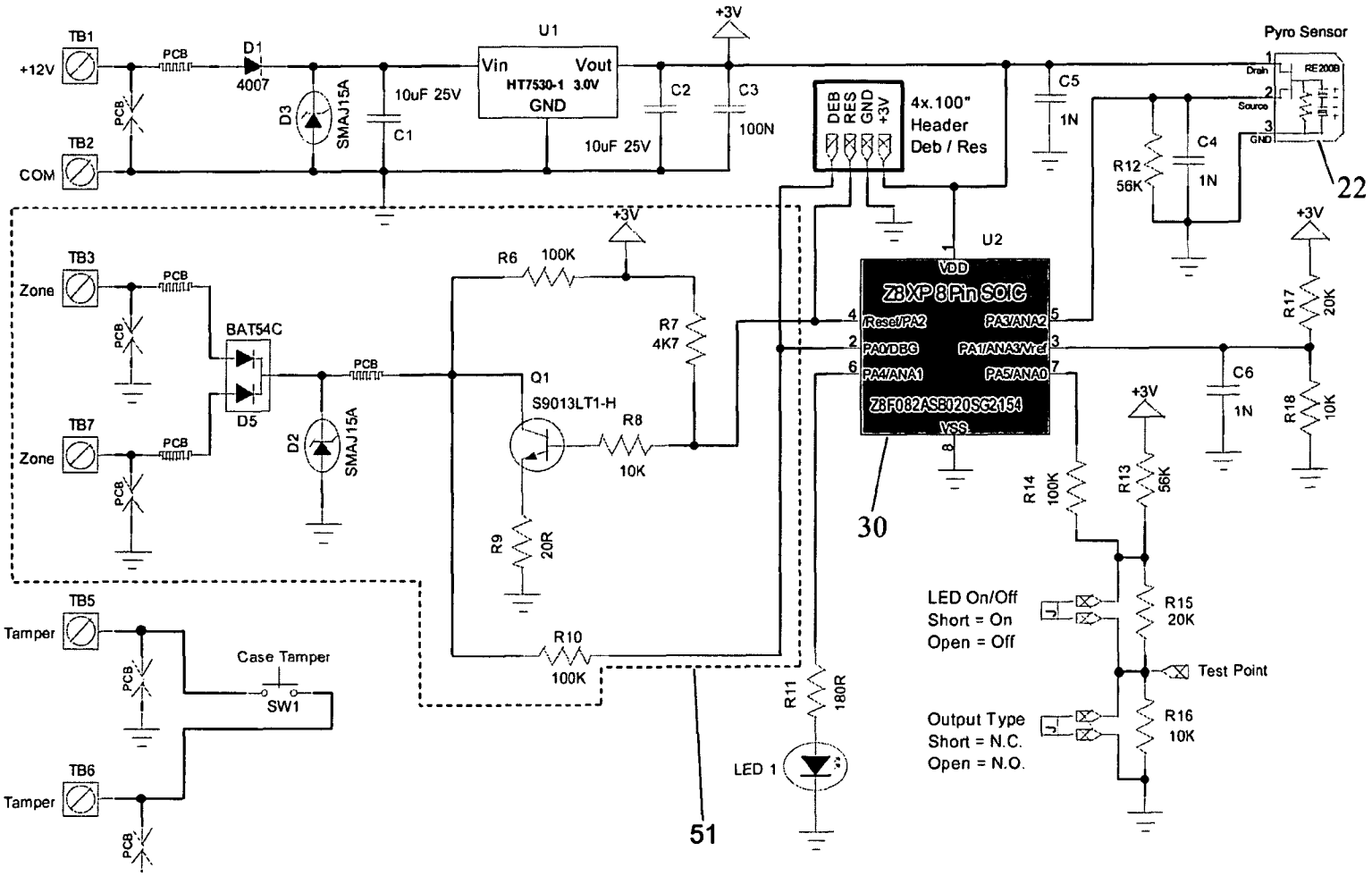
FIG. 4 is a circuit diagram of the energy signal detection system according to the above preferred embodiment of the present invention.
Figure 5:
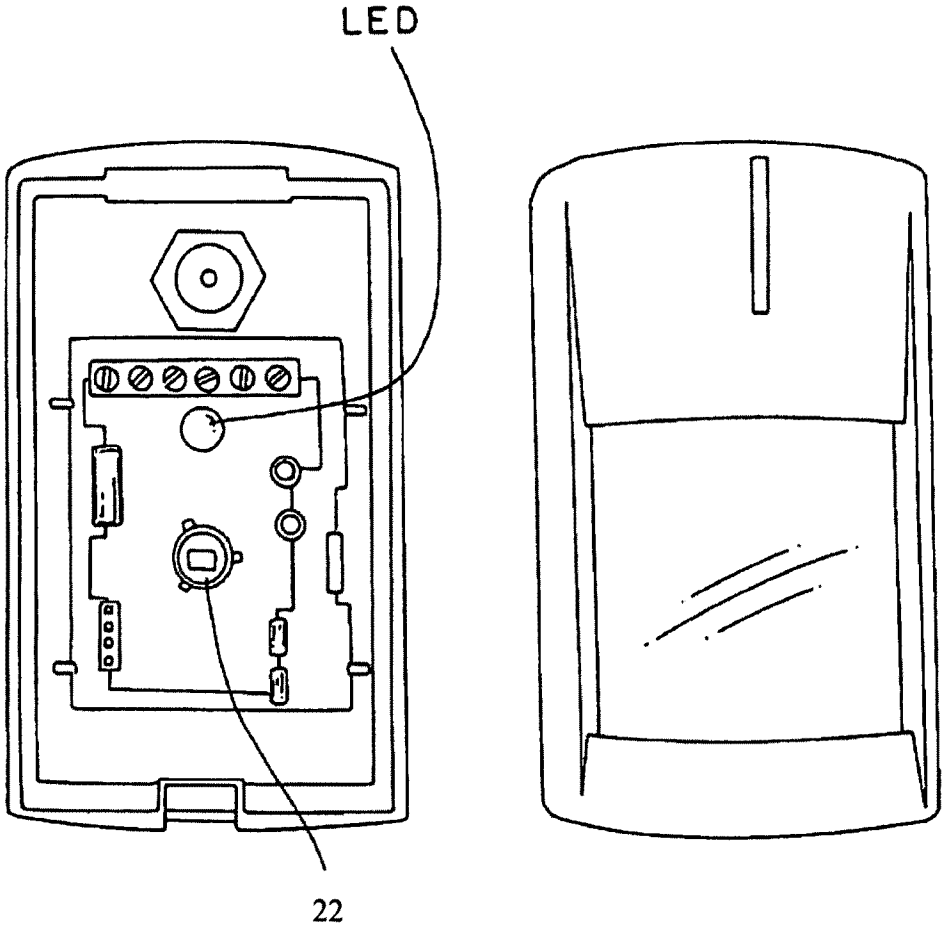
FIG. 5 is an exploded perspective view illustrating the physical components of the energy signal detection system, embodied as a motion sensor, according to the above preferred embodiment of the present invention.
Figure 13:
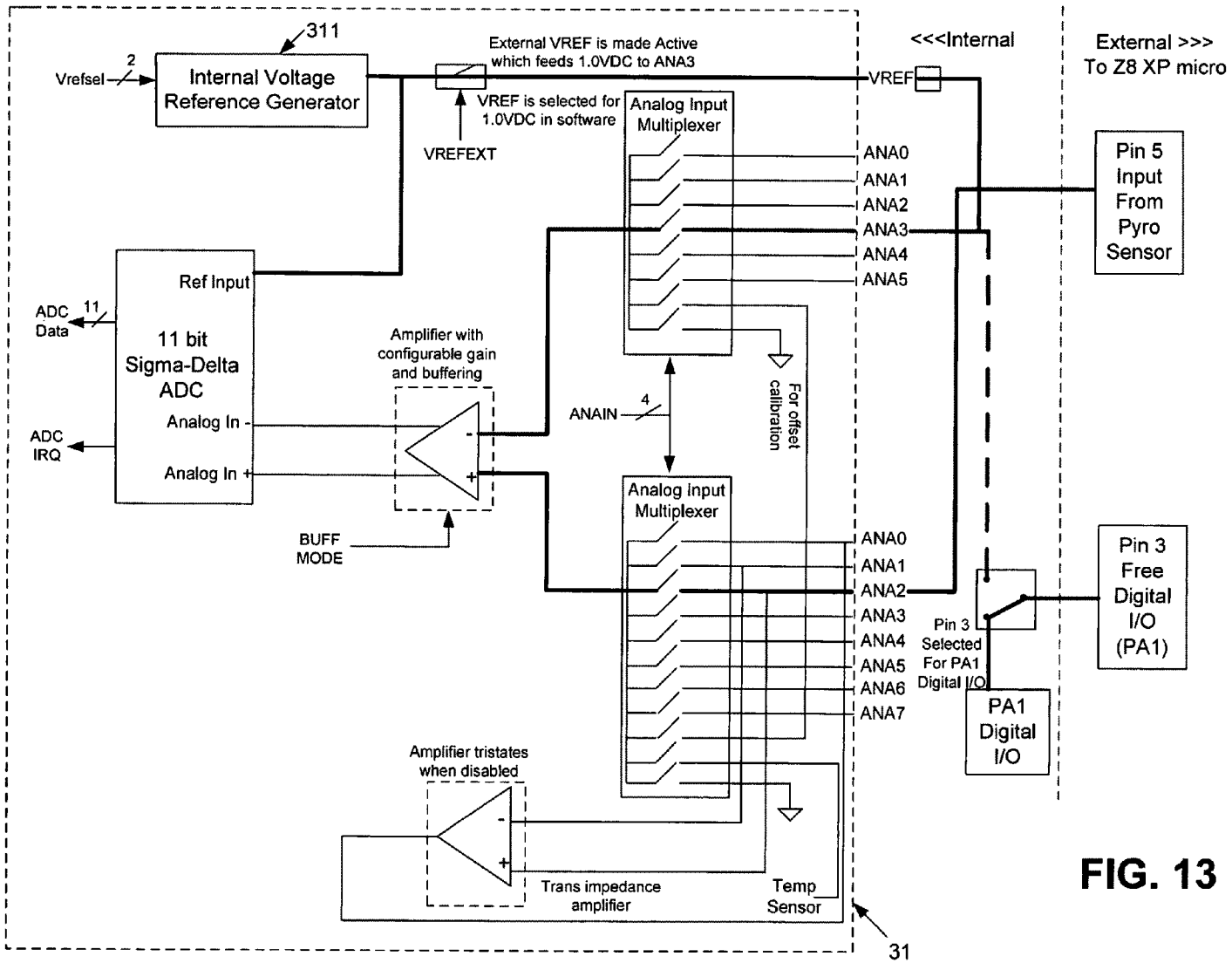
FIG. 13 is a block diagram illustrating the analog-to-digital converter of the energy signal detection system according to the above preferred embodiment of the present invention.

According to the preferred embodiment of the present invention, referring to FIG. 4 and FIG. 13, the microcontroller 30 internally provides a 1V voltage reference (VREF) at the ANA3 node while 0V-2V output signals 23' are fed to the ANA2 node via PIN 5 from the pyroelectric sensor 22, wherein any output signal inputted from the pyroelectric sensor 22 is a positive signed signal when its voltage is between 1V to 2V, or is a negative signed signal when its voltage is between 0V to 1V. Accordingly, such differential input of the output signal 23' from the pyroelectric sensor 22 gives a value equal to the difference between the inputs so as to substantially enhance the input resolution of the A/D converter 31 from 10 bits to 11 bits.

The A/D converter 31 such as the 10 bit sigma delta converter as mentioned above may provide a high degree of accuracy for a tradeoff in conversion speed. Internally the data is guaranteed to 10 bits of accuracy resolution; however several additional bits of resolution become usable by taking multiple samples and constructing them in a pre-designed manner. This provides a very accurate input signal that does not require any significant hardware pre-conditioning.

The A/D converter's resolution can be 16384 steps over a 2 volt range. As the data samples are inputted and buffered, the maximum and minimum sample values are tracked. This is done to reduce the requirement for floating point math operations. By keeping the minimum and maximum readings, the data samples can be normalized back into 8 bit integer data without loosing resolution information, allowing the rest of the heavy data buffering to be done using less memory. If all data are left as floating point then the techniques would not be possible on this low end of the microcontroller 30.

The microcontroller 30 further comprises a temperature sensor 34 for determining a temperature of the target with respect to an ambient temperature so as to control a sensitivity of the microcontroller 30. The microcontroller 30 further comprises an internal 5.5 Mhz oscillators 35, wherein the infrared energy 10' is affected by the ambient temperature, signal analysis taken place at the microcontroller 30 need to be adjusted to take into account any change in ambient temperature as detected by the temperature sensor 34.

According to the present invention, no detected signal will be filtered or removed before it is measured and computed like the conventional energy detection device, wherein when a real signal is erroneously filtered or removed as noise signal, the sensitivity of the energy detection device is adversely affected. Therefore, in order to maximize the sensitivity of the energy detection system and process of the present invention, all output signals 23' are fed to the A/D converter 31 of the microcontroller 30 from the pyroelectric sensor 22 and converted into data samples for data processing to distinguish the real signals and the noise signals.

Figure 6:
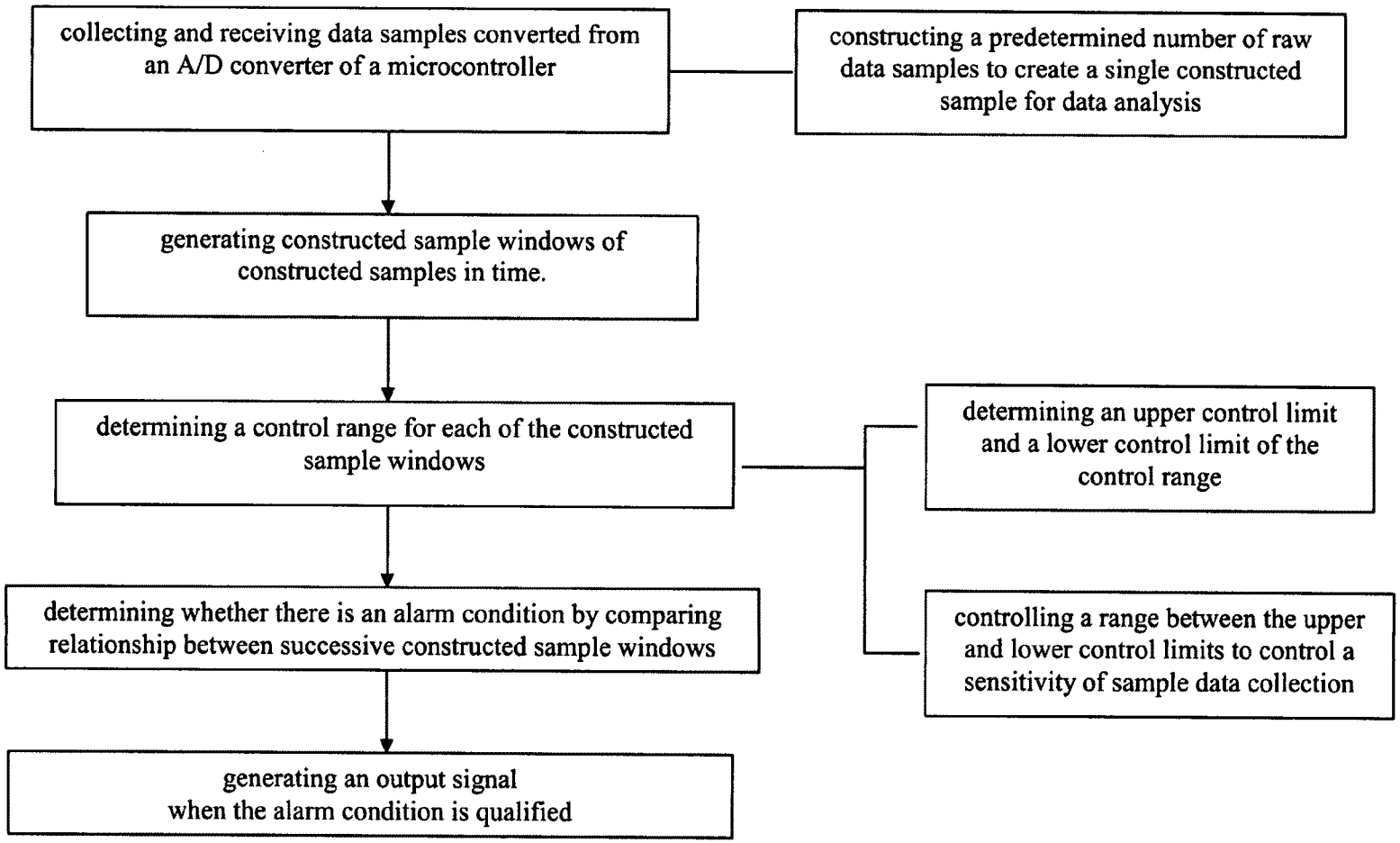
FIG. 6 is a flow diagram for the method of energy signal detection according to the above preferred embodiment of the present invention.

According to the present invention, referring to FIG. 6, the process of energy signal detection comprises the following steps.

(a) Collect and receive a plurality of data samples converted from the A/D converter 31 of the microcontroller 30 and generate a predetermined number of constructed sample windows of constructed samples in time.

(b) Determine a control range for each of the constructed sample windows.

(c) Determine whether there is an alarm condition by comparing relationships between successive constructed sample windows.

(d) Generate an output signal when the alarm condition is qualified.

The step (a) further comprises the steps of:

(a1) acquiring data samples from the A/D converter;

(a2) constructing a predetermined number of raw data samples to create a single constructed sample; and (a3) buffering a predetermined number of constructed samples to form one or more constructed sample windows in time.

In the step (a2), the raw data samples are statistically processed with time. The constructed sample is constructed from the group of raw data samples for the purpose of removing noise and increasing resolution.

According to the preferred embodiment, a plurality of raw data samples is averaged to form a single constructed sample. In other words, none of the conversion signals will be individually taken as accurate measurement. According to the preferred embodiment of the present invention, for example, 18 raw data samples are averaged to form a single constructed sample. It should be noticed that when 4 data samples are averaged to generate the constructed sample, it gives another 1 bit input resolution, and that when 16 data samples are averaged to generate the constructed sample, it gives another 2 bits input resolution. Therefore, the averaging of the data samples into constructed samples further enhances the input resolution for 2 more bits and thus rendering the input resolution of the energy detection system and process of the present invention from 11 bits to 13 bits.

In the step (a3), according to the preferred embodiment of the present invention, since all data samples converted from the output signals from the pyroelectric sensor 22 are treated and averaged into constructed samples for data processing, noise is treated as part of the signals too. Thus, these signals which contain a noise component as well as signal data should be treated and analyzed in a control range manner. The calculation of the control range of a constructed sample window in time comprises a predetermined number of successive constructed samples, for example 26.

Figure 7A:
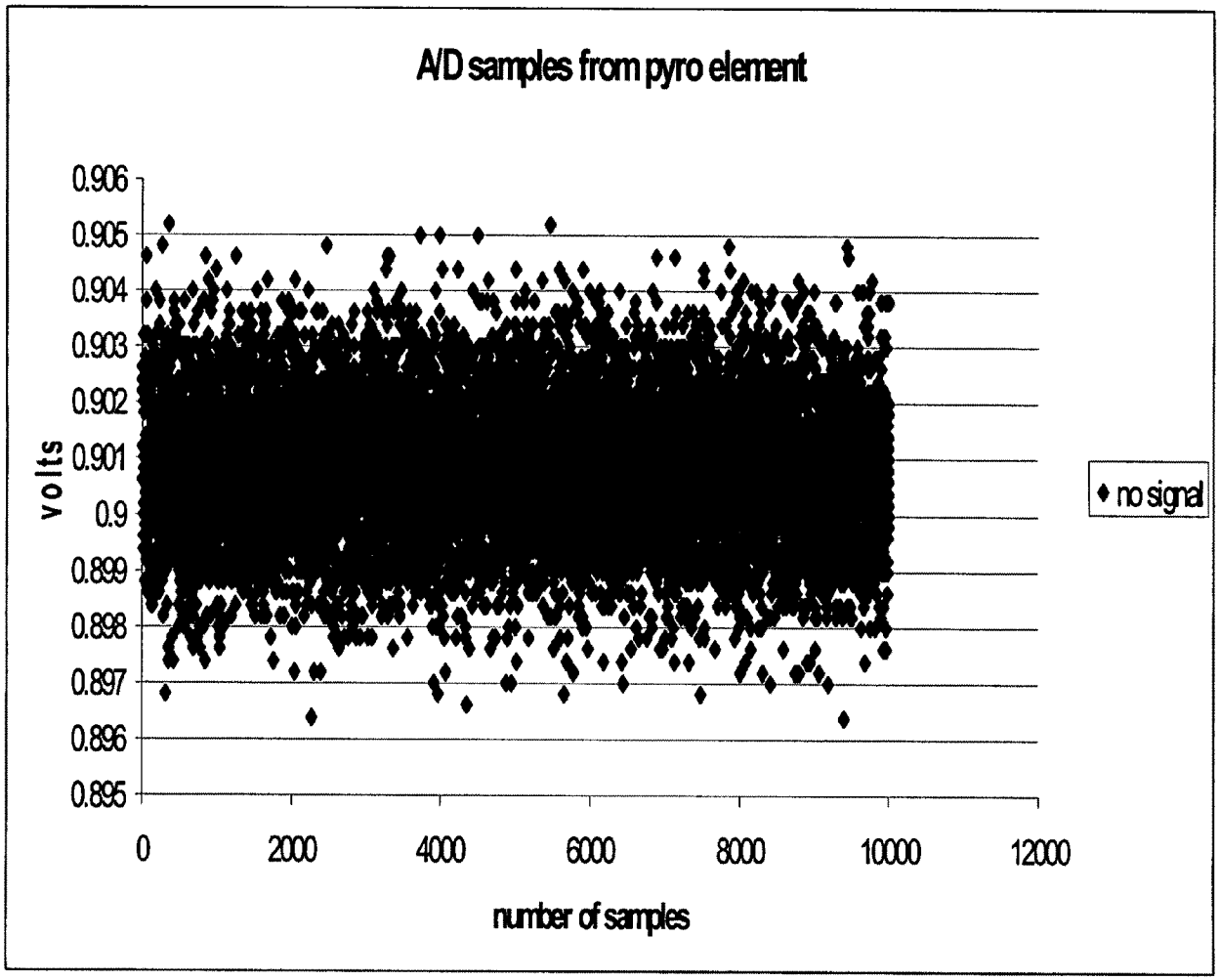
FIG. 7A is a chart illustrating A/D samples from pyroelectric sensing element when there is no signal according to the above preferred embodiment of the present invention.
Figure 7B:
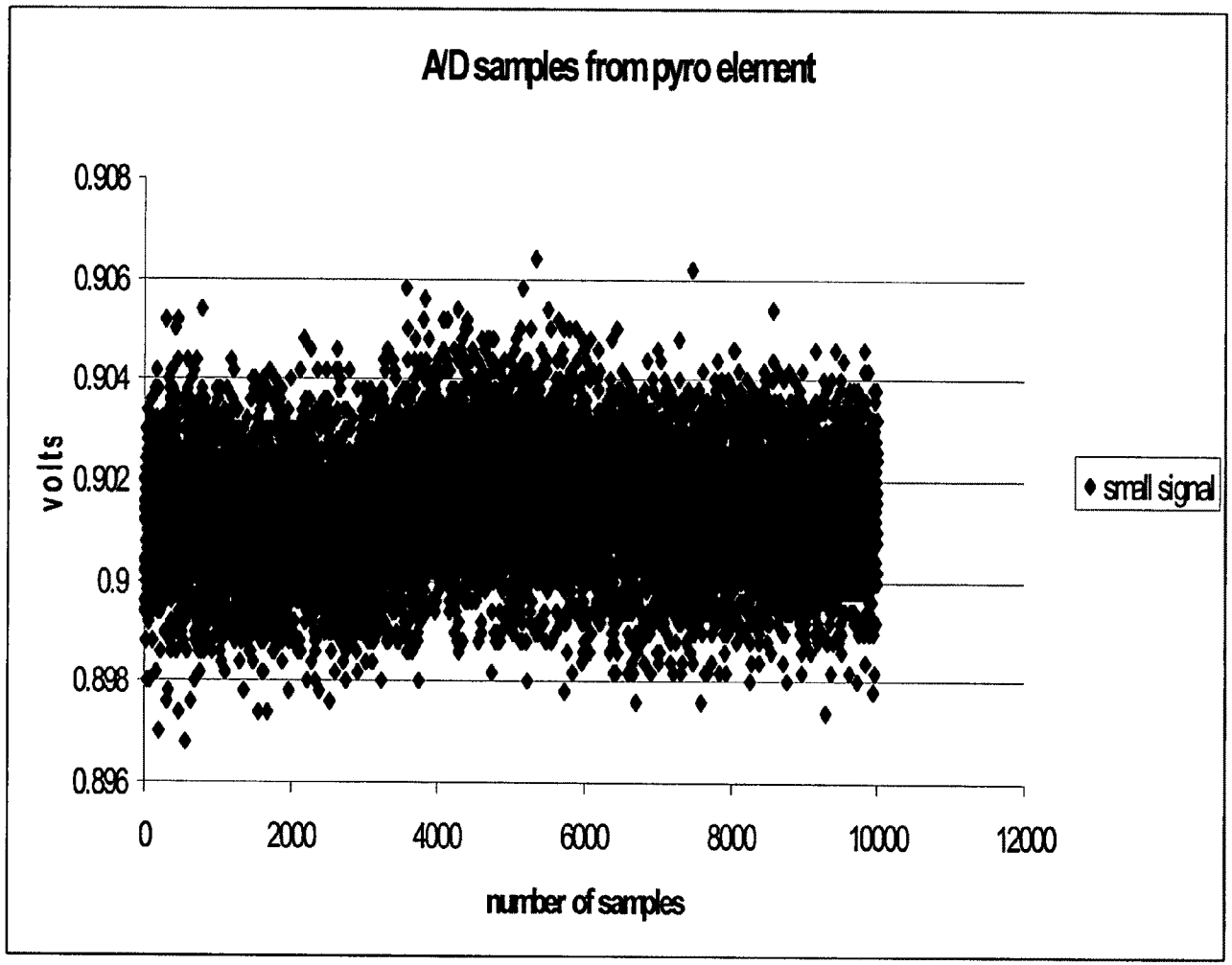
FIG. 7B is a chart illustrating A/D samples from pyroelectric sensing element when there is small signal according to the above preferred embodiment of the present invention.

Referring to FIGS. 7A and 7B, if the data samples, including real signals and noise, are analyzed, it is found that it is normally distributed. With normally distributed data, a textbook shortcut can be used to calculate the standard deviation. It is appreciated that 68.26% of the data will fall within 1 standard deviation of the mean, 95.46% of the data will be within 2 standard deviations, and 99.73% will fall within 3 standard deviations. In other words, by means of three standard deviations, 99.73% of all the constructed samples are expected to fall within the control range of the respective constructed sample window.

One such rigid characteristic is that 99.73% of the data that make up a normal distribution falls within standard deviations of the average. In practice, it is assumed that all data points plotted should fall within the three standard deviation limits, i.e. Upper Control Limit (UCL) and Lower Control Limit (LCL). This appears reasonable given the very low incidence of data points falling outside the UCL and LCL in a normal distribution (3 in 1000).

In the step (a3), the prerequisite factors for calculating the control range are determined from each constructed sample window. These factors are, the constructed sample window range, i.e. constructed sample maximum (MAX)—constructed sample minimum (MIN), and the constructed sample window average (AVE), i.e. sum of constructed samples divided by number of constructed samples.

In the step (b), in order to determine the control range of each of the constructed sample windows, the UCL and LCL of each of the constructed sample windows can be computed by taking the constructed sample window average (AVE) and adding/subtracting the constructed sample range multiplied by an A2 factor, wherein the A2 factor is a coefficient that is based on the size of the constructed sample window, i.e. the number of constructed sample being put together in that constructed sample window. It only works for normally distributed data. In other words, the A2 factor is an efficient and quick method for calculating the standard derivations, for example 3 standard derivations. It can only be used with the distribution of the data is normal distributed (i.e. Gaussian/Bell Curve). The A2 factor of a constructed sample window size of 20 is 0.16757. The formula for computing the A2 factor is "A2 Factor=1.7621 (constructed sample window size) to the exponent of (−0.7854)".

Figure 8:
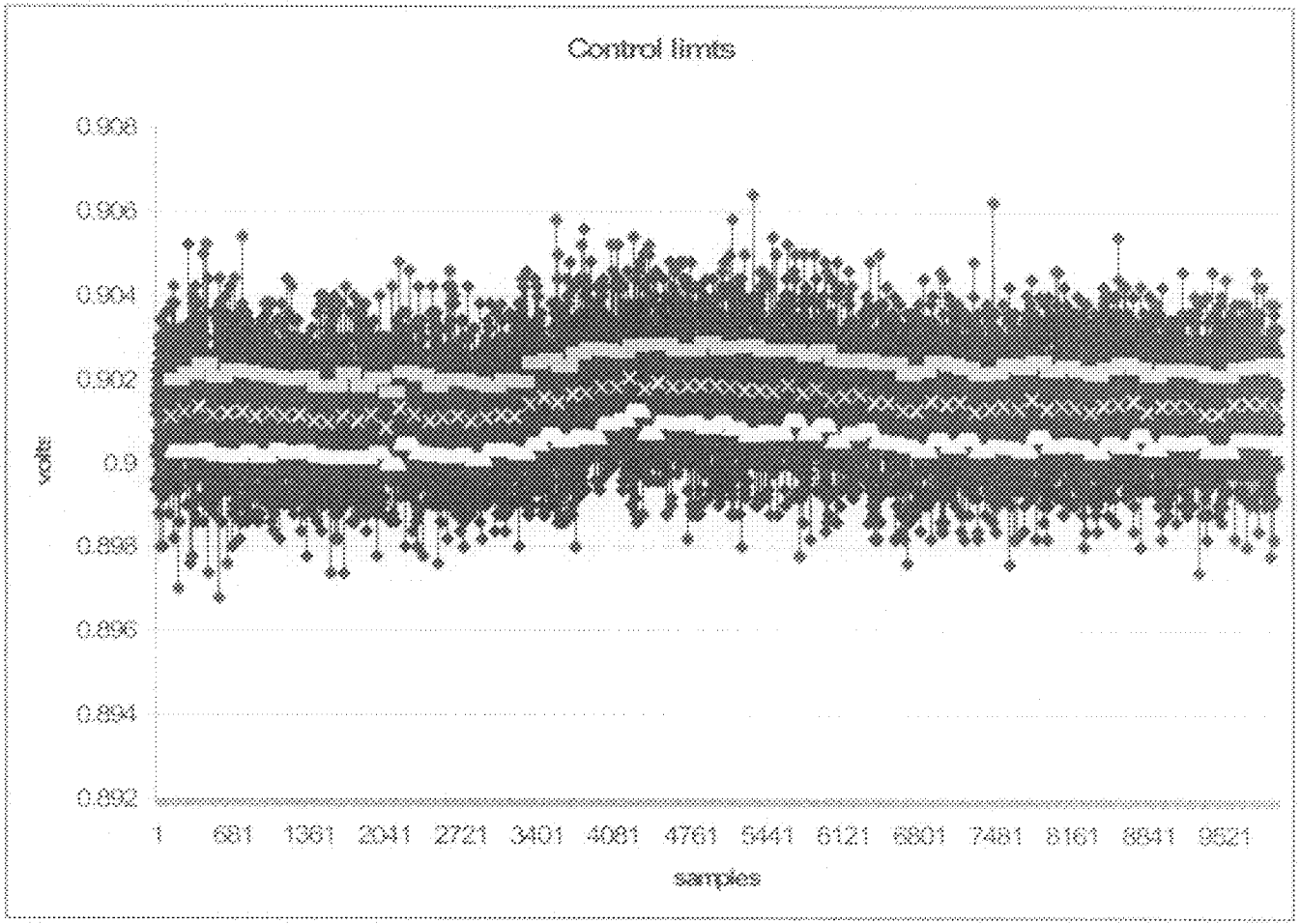
FIG. 8 is a chart illustrating the Upper and Lower Control Limits of the present invention according to the above preferred embodiment of the present invention.

In other words, the decision of the alarm pre-condition is not based on the raw data samples or individual constructed sample data, but based on the Upper Control Limits and Lower Control Limits of the constructed sample windows, as shown in FIG. 8, wherein the UCL and LCL are calculation for each constructed sample window as follows:

$$UCL=AVE+A2\times\text{Range}$$

$$LCL=AVE-A2\times\text{Range}$$

Figure 9:
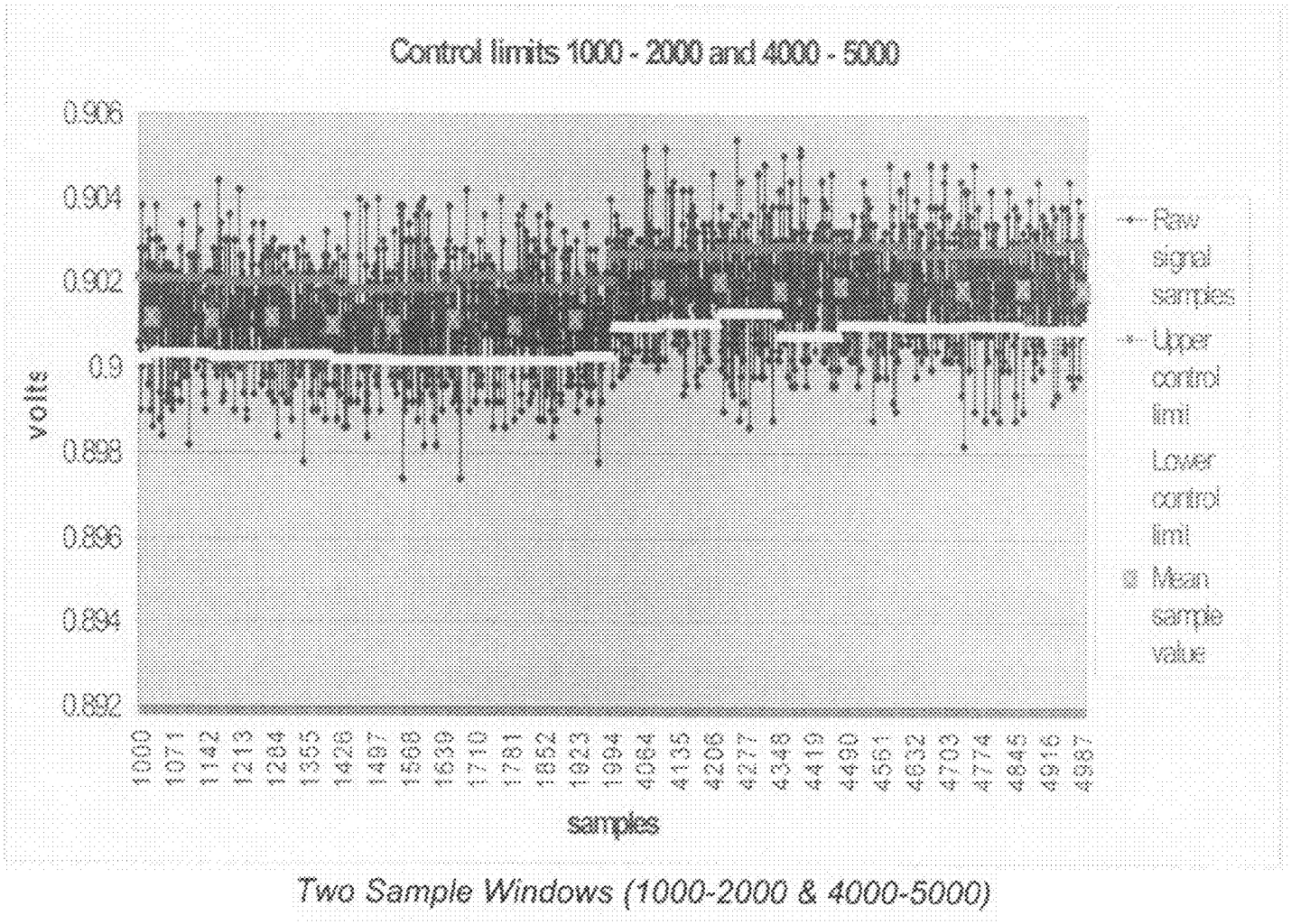
FIG. 9 is a chart illustrating the 1000-2000 sample window and the 4000-5000 sample window according to the above preferred embodiment of the present invention.
Figure 10:
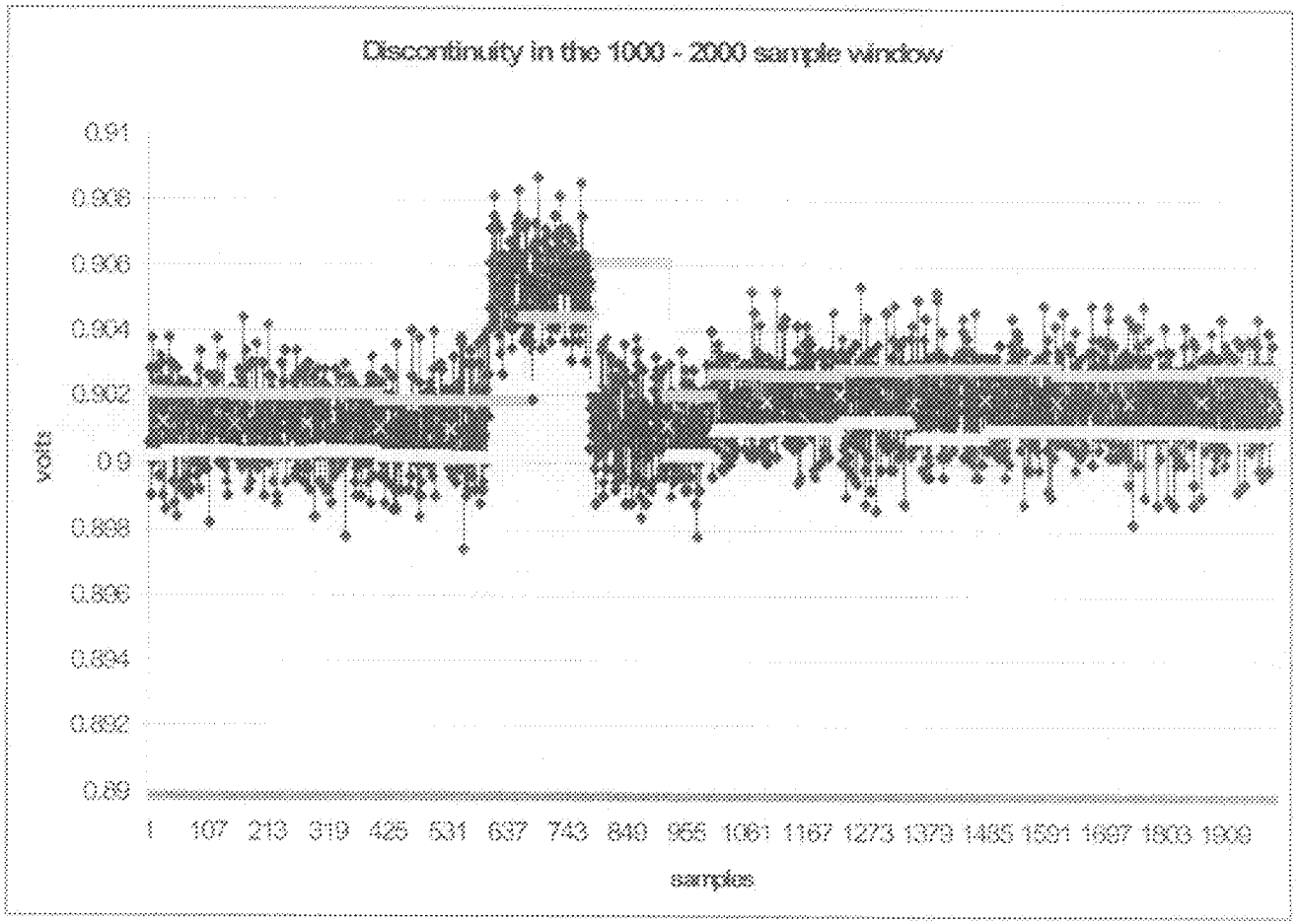
FIG. 10 is a chart illustrating discontinuity in the 1000-2000 sample window according to the above preferred embodiment of the present invention.

In order to use the Upper and Lower Control Limits in real time, the present invention provides a plurality of control limits at differing time intervals, so that it can use said control limits (UCL/LCL) for comparing the relationships between the control limits (UCLs/LCLs) of two or more constructed sample windows to determine the alarm pre-condition. This requires the present invention to be able to buffer a fair amount of data, i.e. constructed samples. This is the reason that the raw data samples are normalized from floating point back to 8 bit data values. It is appreciated that the embodied microcontroller 30, i.e. the ZiLOG Z8 XP 8 Pin SOIC, has 1000 bytes of internal ram storage. FIG. 9 shows the 1000-2000 sample window and 4000-5000 sample window. FIG. 10 shows discontinuity in 1000-2000 sample window.

The step (c) further comprises the following steps:

(c1) Group a predetermined number of successive constructed sample windows to form a window group for comparing the relationships between the successive constructed sample windows of the window group, wherein a space is formed between every two successive constructed sample windows. According to the preferred embodiment, four successive constructed sample windows are put together to form a window group and the space between the two successive constructed sample windows is preferred to be made of 1 to 2 constructed samples.

(c2) Analyze any statistically significant change among the control limit ranges between their UCL and LCL of the constructed sample windows in the window group to distinguish between noise and real signals so as to determine whether there is an alarm pre-condition.

In the step (c2), in order to have a significant alarm event, all the successive constructed sample windows in the window group must follow the same direction of trend change.

Figure 14A:
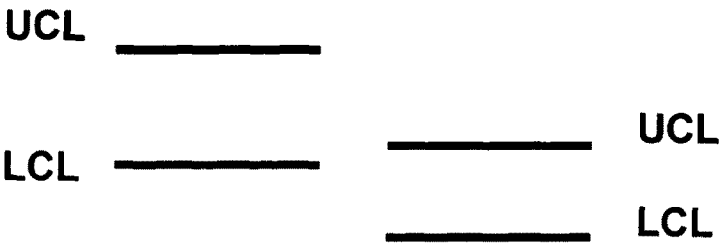
FIGS. 14A-C are diagrams illustrating various types of crossing between constructed sample windows in the window group according to the preferred embodiment of the present invention.
Figure 14B:
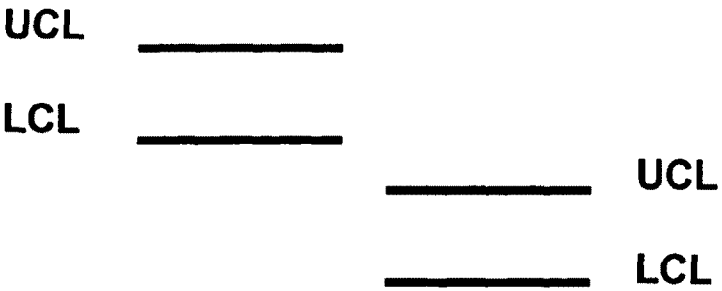
Figure 14C:
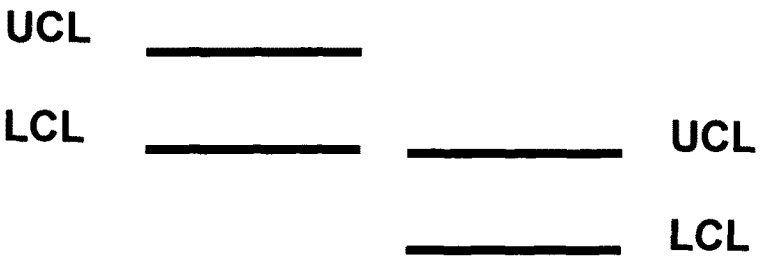

According to the present invention, crossing between two successive constructed sample windows means one of the UCL and LCL of one constructed sample window is compared with one of the complimentary control limit (UCL/LCL) of another previous or subsequent constructed sample window in a window group for variation, such as a less than crossing as shown in FIG. 14A, a greater than crossing as shown in FIG. 14B, a equal to crossing as shown in FIG. 14C, wherein the percentage of crossing can be ranging from 50% to 500%.

Figure 15A:
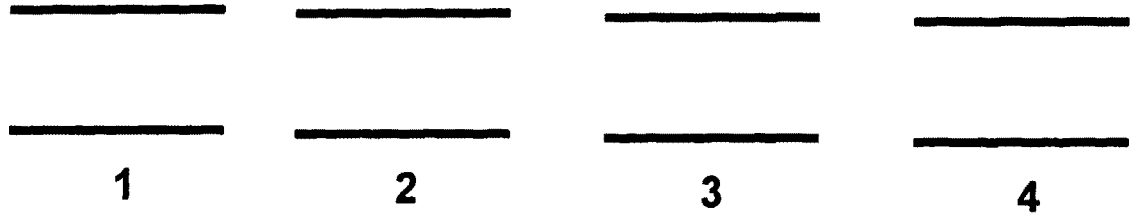
FIG. 15A is a diagram illustrating a no-crossing change of the constructed sample windows in a window group according to the preferred embodiment of the present invention.
Figure 15B:
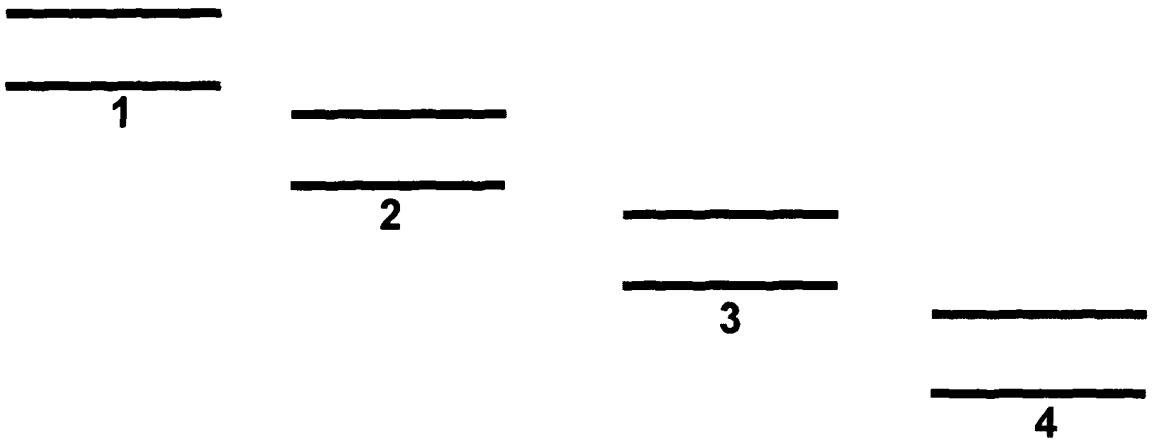
FIG. 15B is a diagram illustrating a crossing down change of the constructed sample windows in a window group according to the preferred embodiment of the present invention
Figure 15C:
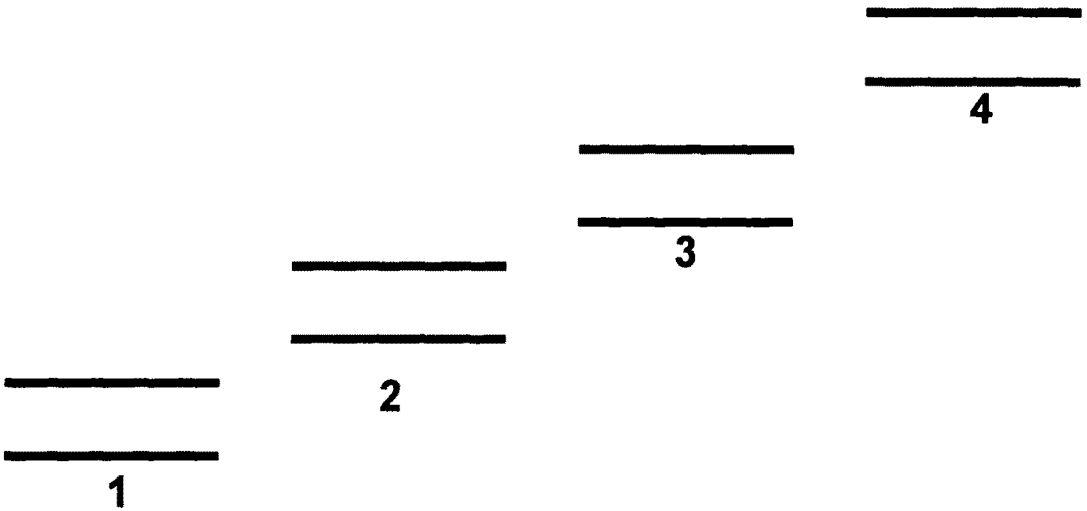
FIG. 15C is a diagram illustrating a crossing up change of the constructed sample windows in a window group according to the preferred embodiment of the present invention.

For example, as shown in FIG. 15A, when the constructed sample windows in the window group are in a row, no alarm pre-condition will be considered. When the 1-4 constructed sample windows in the window group are either crossing in a down trend as shown in FIG. 15B or crossing in an up trend as shown in FIG. 15C, it starts to qualify an alarm pre-condition.

After the step (c2), the step (c) further comprises a step (c3) of identifying the crossing among constructed sample windows in the window group to determine whether the alarm pre-condition is created by noise or real signals by means of the slope or trend of the constructed sample windows.

In the step (c3), for normal energy signal detection, a first slope detection is processed. Depending on the size of the data buffer, a predetermined number of window groups is analyzed as buffering window groups at one time for sloping direction and the microcontroller 30 is statistically preset to determine an alarm condition when a first predetermined number of window groups out of the predetermined number of buffering window groups trend in the same direction, e.g. down trend or up trend. According to the preferred embodiment of the present invention, the data buffer can be fed with 100 or more constructed samples at any point of time, so that 24 buffering window groups are being analyzed and, at any point of time, at least 17 window groups, for example, out of the 24 buffering window groups must trend in the same direction, with no reverse trend while neutral trend being all right, in order to qualify the alarm pre-condition into an alarm condition. When any window group of the buffering window groups is not trending towards the same direction, said buffering window groups at that time are discarded.

It should be noted that if any reverse direction happens for any window group with the buffering window groups, it must be something wrong with the system and it reflects as no actual condition of the detecting area. Then, the process is reset.

For fast energy signal detection, a second slope detection is processed in the step (c3) in addition to the first slope detection. Every time when a new constructed sample is fed into the data buffer, the microcontroller 30 recalculates all the conditions, including the slope response of the window groups and the control limits, to determine whether the down trend or up trend of the constructed sample windows is a fast trend.

When a fast trend is found, such as the condition that a person is running quickly across a PIR motion sensor (the energy signal detection system), a predetermined number of fast constructed sample windows is grouped, wherein each fast constructed sample window contains a predetermined number of successive constructed samples, for example four. According to the preferred embodiment of the present invention, for example, three fast constructed sample windows are required to form a fast window group for determining the slope trend, wherein each space between two successive fast constructed sample windows is made of 1 to 2 constructed samples.

In order for any fast window group to be considered, all fast constructed sample windows in the fast window group should be either in an up trend or a down trend manner. To determine whether there is an alarm pre-condition, according to preferred embodiment at least five successive fast window groups are sloping either in an up trend manner or a down trend manner to start a period measurement process.

When there are five or more fast window groups trending towards a direction within a certain predetermined time period, it is an illustration that there is a valid slope and the system will look for any complimentary slope within a qualified time period. The slope of the UCL/LCL substantially helps to determine the nature of the signals. Technically speaking, fast movement always generates frequency component and therefore the time period is measured. If the period of time is too short or too long, it indicates frequency outside the interest of the system and the system discards it.

After a first occurrence of five or more fast window groups being trend towards an initial direction, either up trend or down trend, a first timer starts to count for a second occurrence of the subsequent five fast window groups trend towards an opposite direction which triggers a second timer to start to count while the first timer stops. The second timer will count for a third subsequent occurrence of another five fast window groups being trend towards the initial direction. Then, the second timer stops and the first timer will start to count for a fourth occurrence of subsequent five fast window groups being trend towards the opposite direction of the initial direction. Then, the first timer stops again and the second timer starts again to count for a fifth occurrence of subsequent five fast window groups being trend towards the initial direction again.

According to the preferred embodiment, the above detection process is set for three cycles of period detection, including three up trends and three down trends in order to trigger the alarm condition. In other words, each half cycle has five fast window groups trending towards the same direction within a predetermined time period, indicating an alarm condition and thus qualifying the alarm pre-condition into the alarm condition. In the step (d), when an alarm condition is determined, the system generates an output signal to change the output state from restore to alarm for a predetermined time period according to the preferred embodiment, giving an alarm pulse for at least one second to the control panel or corresponding device connected to the energy signal detection system.

Conventionally, in order to prevent false alarms created by white light, a costly lens made of specific material that can block white light is equipped with the energy signal detection system to filter the white light. Alternatively, the lens or the sensor is installed with a white light filter to filter the white light. This filter approach is not only costly but will reduce sensitivity under all conditions even for the intended operation of infrared energy detection regardless of the presence of white light or not. Some conventional devices contain a white light detector, such as a CDS photocell detector, to give the detector the ability to measure the presence of white light so the detector can qualify the validity of the white light so as to not create a false alarm. While this approach is better then a filter, it is also costly as well.

Figure 11:
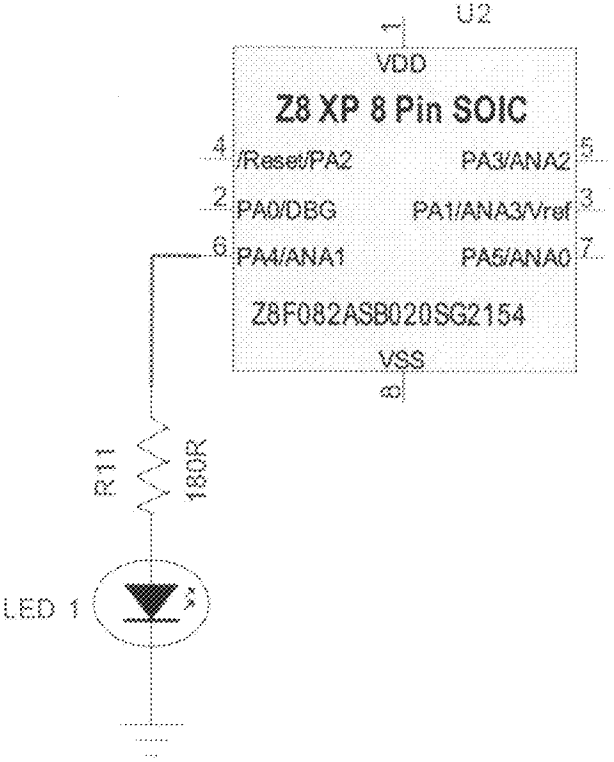
FIG. 11 is an enlarged schematic circuit diagram illustrating the white light detector of the energy signal detection system according to the above preferred embodiment of the present invention.

The present invention substantially provides a most economic and innovative method to solve the white light problem by simply taking advantage of the LED that is generally contained in all kinds of energy signal detection system, such as a motion sensor, for indicating movement occurred and whether the sensor is in an ON/OFF condition to the user walking by, without installing any additional part or component. Referring to FIG. 11, the energy signal detection system of the present invention comprises a light emitting diode (LED) electrically connected to PIN6 of the microcontroller 30 and a resistor R11 in series in such a manner that when white light sights on the LED, a measurable mini voltage signal will be generated, which is a mini-voltage change proportional to the intensity of the white light on the LED. The voltage signal is utilized in the energy signal detection system of the present invention as a white light detection and feeds into the microcontroller 30 for data processing.

Figure 12:
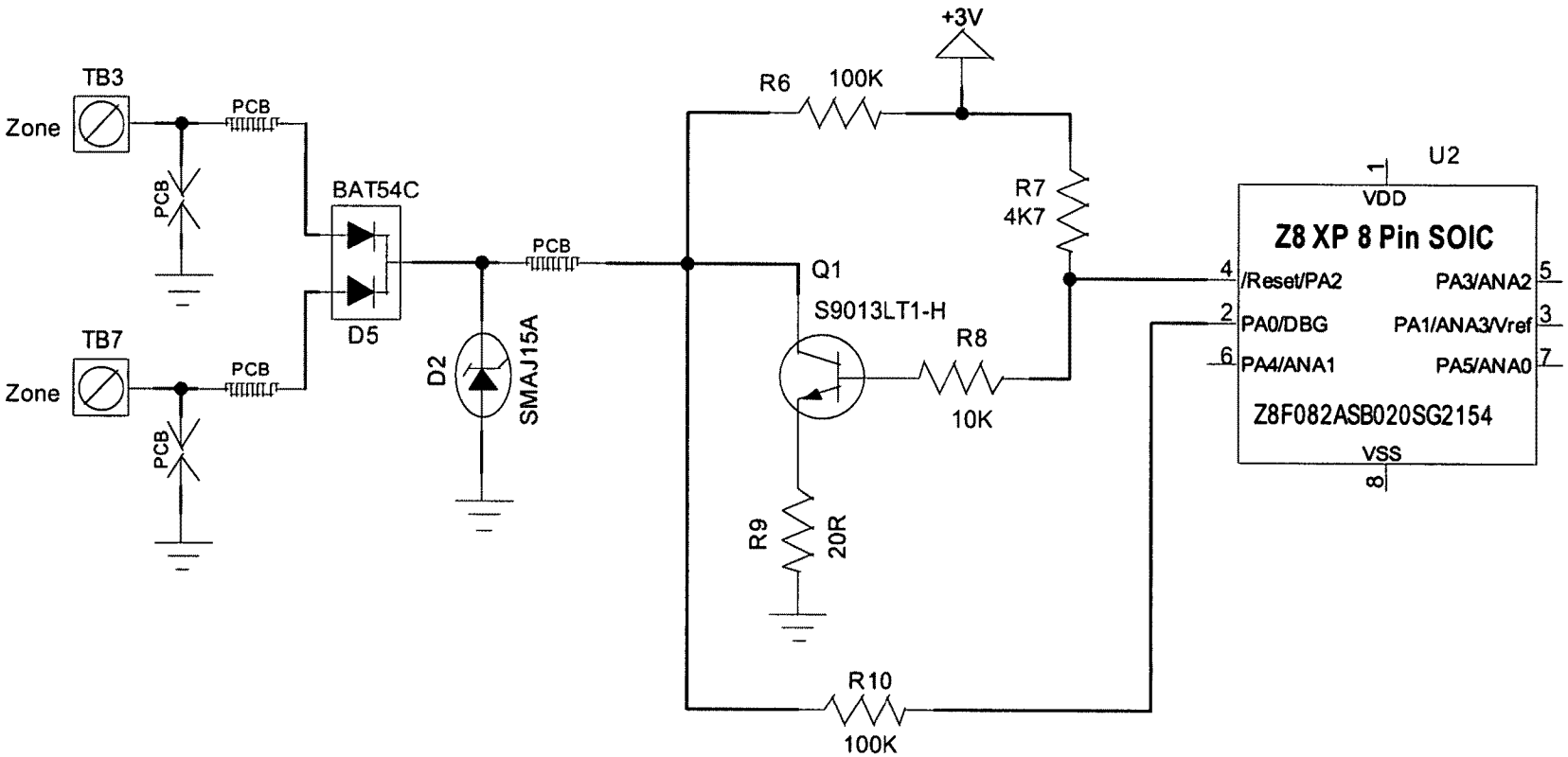
FIG. 12 is an enlarged schematic circuit diagram illustrating the non polarity sensitive alarm output circuit of the energy signal detection system according to the above preferred embodiment of the present invention.

Referring to FIG. 4, the alarm output circuit of the energy signal detection system according to the preferred embodiment of the present invention is a non polarity sensitive alarm output circuit which is a non polarity output by dual switching the ZONE and COM connections of the control panel to ground. Conventional, motion sensors or other energy signal detection system output and connected to the ZONE and COM connections of a control alarm panel or other equipments by using a relay. According to the present invention, no relay is required and that a dual switch to GND is provided. FIG. 12 shows a schematic of the non polarity sensitive alarm output circuit.

Figure 16A:
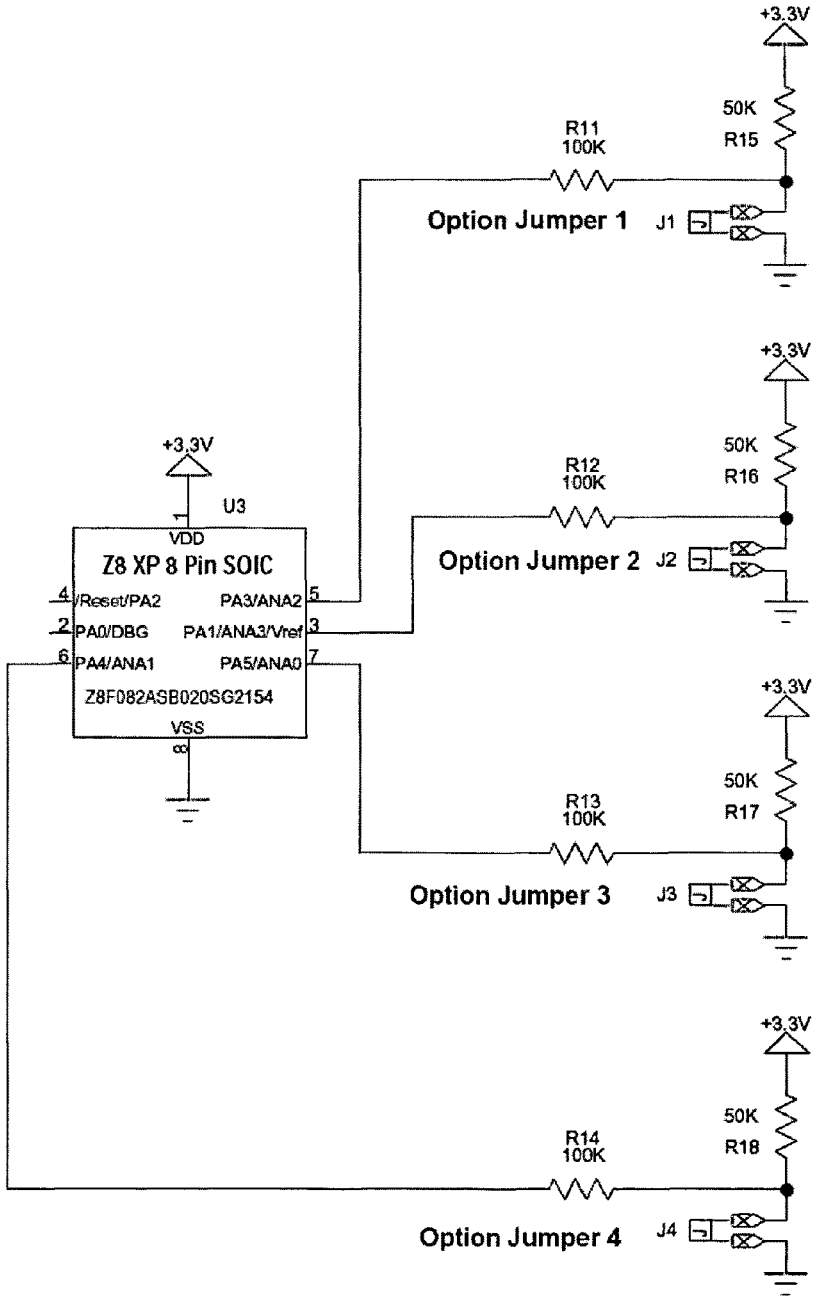
FIG. 16A Prior Art
FIG. 16A is a circuit diagram illustrating a traditional jumper circuit.
Figure 16B:
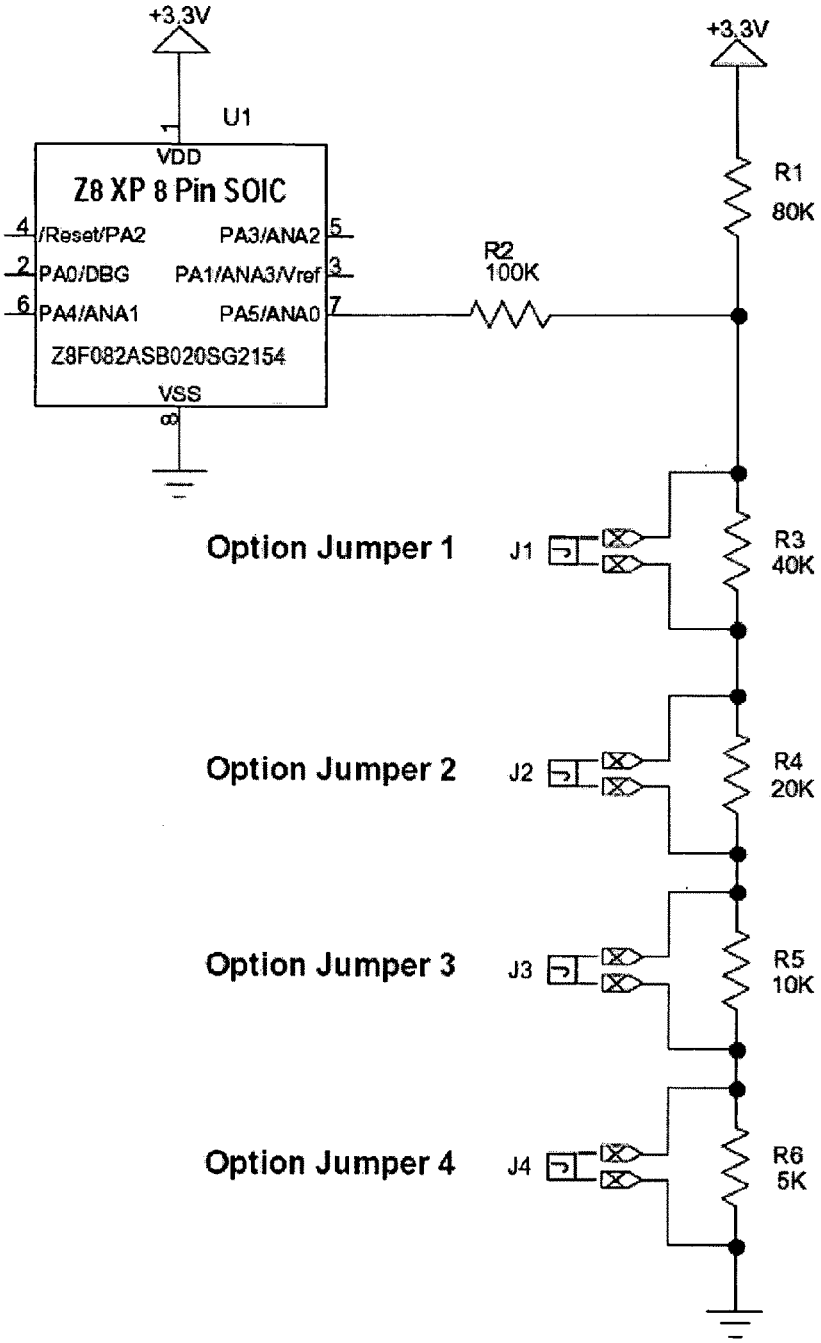
FIG. 16B is a circuit diagram illustrating a jumper tree circuit according to the above preferred embodiment of the present invention.

Referring to FIG. 16A, if a traditional jumper circuit is used with the microcontroller 30, each option jumper requires a separate input on the microcontroller 30, a separate input resistor (R11, R12, R13, R14), a separate pull up resistor (R15, R1, R17, R18), and a power consumption (current through the pull up resistor when the jumper is present). Referring to FIG. 16B, a jumper tree circuit is used in the energy signal detection system according to the preferred embodiment of the present invention, which comprises two or more option jumpers connected in series with the PINT of the microcontroller 30. As shown in FIG. 16B, supporting multiple jumpers 1 to 4 requires only one A/D converter input (ANA0), only one pull up resistor (R1), only one input resistor (R2), and a single "weighted" resistor for each jumper, wherein the power consumption (current through the pull up resistor (R1)) is lower than the conventional jumper circuit. It is worth to mention that, a predetermined number of jumpers equal (a predetermined squared) number of combinations that can be read by the A/D converter. For example four jumpers equals 16 unique voltage ranges that can be read by the A/D converter and decoded in software to determine the status of each jumper.

Figure 16C:
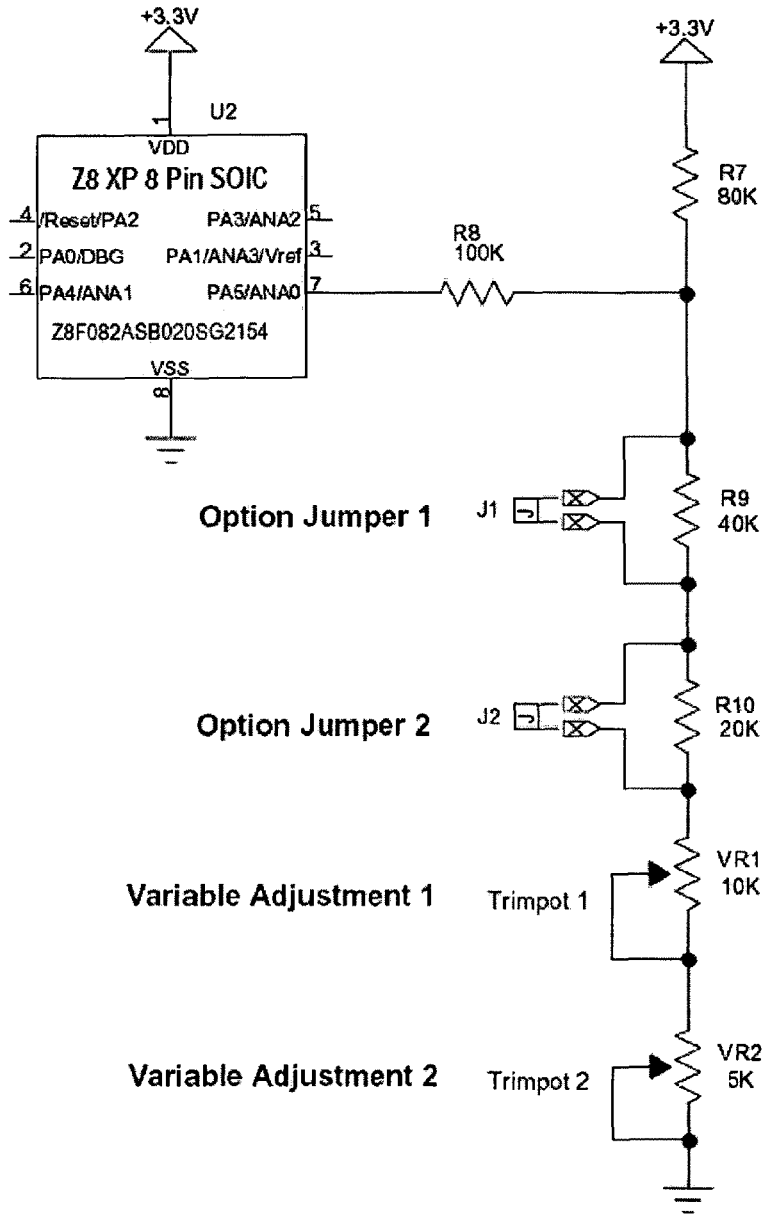
FIG. 16C is a circuit diagram illustrating an alternative mode of the jumper tree circuit according to the above embodiment of the present invention.

Referring to FIG. 16C, an alternative mode of the jumper tree circuit as shown in FIG. 14B according to the preferred embodiment of the present invention is illustrated, wherein one or more variable resistors are used. Referring to FIG. 16C, it can be noted that the A/D converter input is read and decoded into a number of ranges. Each jumper or variable resistor represents a range of values. This allows the value of one or more weighted variable resistors to be decoded along with the status of the jumpers. This also allows for a number of YES/NO options (jumpers) as well as a number of ranges (variable resistors for sensitivity, volume, intensity etc.) to be read and decoded by the A/D converter and the software on a single A/D converter input.

According to the above description of the process and system of energy signal detection substantially achieve the following features:

(1) The process and system of energy signal detection not only improves the sensitivity, performance and reliability thereof, but also reduces false alarms by distinguishing between noise and real signals.

(2) All energy signals detected are being inputted for distinguishing between environmental noise and real signals through statistical computation. In other words, no energy signal will be filtered before computation like the conventional energy signal detector that may result in removing real signals at the same time while filtering noise signals.

(3) According to the process and system of energy signal detection of the present invention, the environmental noise and real signals included in the detected energy signals being inputted are distinguished by means of the control ranges between Upper Control Limits (UCL) and Lower Control Limits (LCL) which are calculated and used based on standard deviations points and the A2 factor.

(4) It improves energy input resolution by providing a differential voltage reference internally for the inputted energy signals.

(5) The present invention further increases resolution by not taking any signal conversion as an accurate measurement of the signals but to sample all inputted energy signals with time for data processing.

(6) The process and system of energy signal detection provides a non polarity output by dual switching the "ZONE" and "COM" connections of the control panel to ground.

(7) The process and system of energy signal detection of the present invention can avoid false alarm created by white light without the use of complicated and expensive lens that is made to block the white light or the installation of a white light filter on the lens or the sensor or a white light detector, such as CDS photocell detector.

Figure 17:
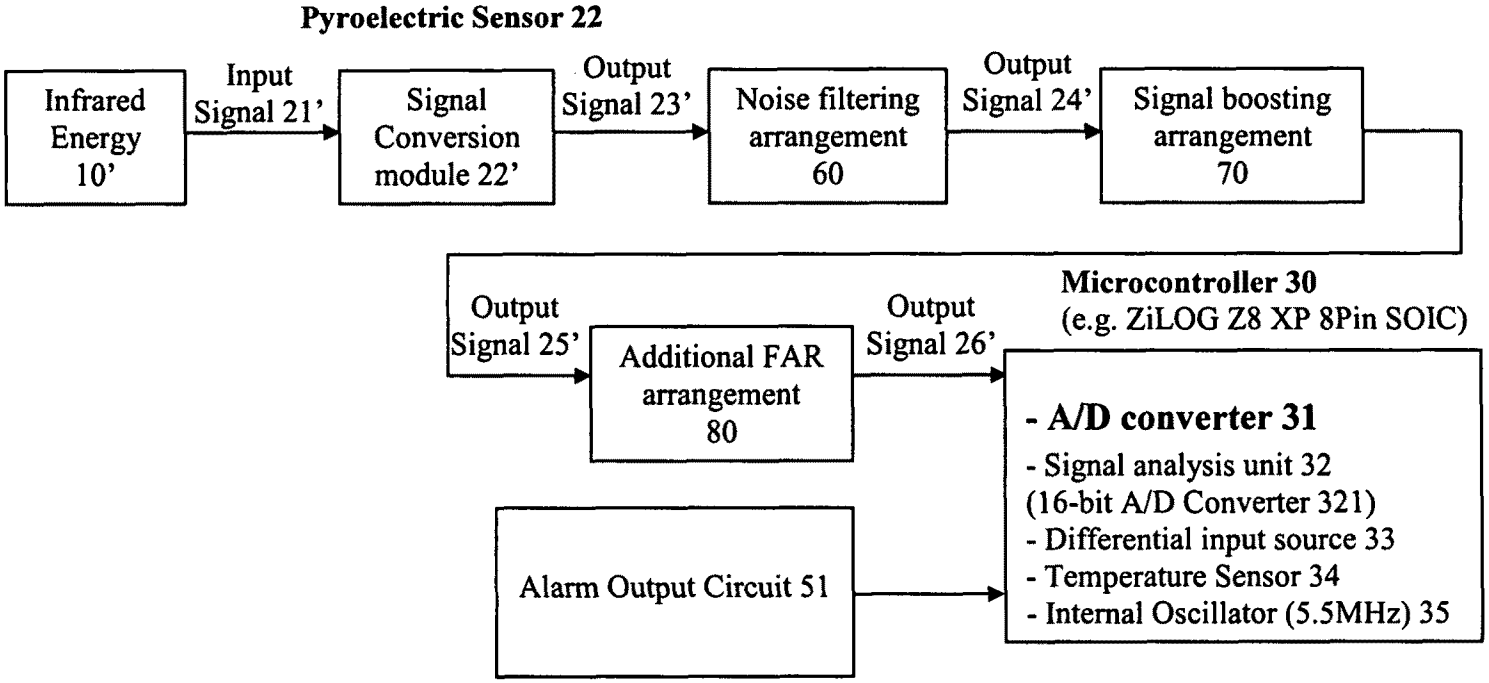
FIG. 17 is a block diagram of a system of energy signal detection according to a preferred embodiment of the present invention.

In another embodiment, referring to FIG. 17, the output signals 23' directly input to the noise filtering arrangement 60 to filter the noise signals. The output signals 24' of the noise filtering arrangement 60 contain real signals with low frequency and some remain of noise signals that are not removed during the noise filtering arrangement 60. The output signals 24' feeds into signal boosting arrangement 70 to amplify the real signals and some remain of the noise signals. After this stage, the output signals 25' contain amplified real signals and noise signals which are not removed during the noise filtering arrangement 60. Since the noise signals will cause false alarms, the output signals 25' is fed into the additional false alarm arrangement 80 to reduce the false alarms. Then the output signals 26' is fed to the microcontroller 30 for further processing.

If an alarm signal should be sent to an ACP or if there is a need to trigger the built-in audio siren 531 or LED matrix 532, the microcontroller 30 will further determine with considering the status of the ACP. If the ACP is in armed status, the microcontroller 30 will send alarm signal to ACP or trigger the built-in audio siren 531 or LED matrix 532. Otherwise, the microcontroller 30 will keep checking the "AUX power" 41 of ACP.

Referring to FIG. 2, the microcontroller 30 receives signal from the low battery test point (LBTP) to monitor the status of the back up power supply 42. When the microcontroller 30 detects the capacity of the back up power supply 42 is low, then the microcontroller 30 will send alarm signal to ACP to indicate low energy. Once the ACP receives the alarm signal, it will send the siren input signal to the microcontroller 30. The microcontroller 30 will drive the high peak build-in siren 531 and LED matrix 532 to send the low energy level warning messages.

Referring to FIG. 2, the microcontroller 30 receives signal from the AUX power test point (APTP) to monitor the status of the AUX power from the terminal 20. When the microcontroller 30 detects "AUX power" is disconnected or lost, the microcontroller 30 will send alarm signals to ACP. Once the ACP receives the alarm signal, it will send the siren input signal to the microcontroller 30. The microcontroller 30 will drive the high peak build-in siren 531 to send the audible warning message. At the same time, the LED matrix 532 will flash to send visual warning message. When the ACP is destroyed by intruders, "AUX power" 41 is lost and there is no power connected with the device 10. At this time, the back-up power supply 42 will provide power for the device 10 so that the build-in siren 531 and LED matrix 532 will send audible and visual warning messages.

The tamper switch 25 which prevents someone from damaging the device 10 is connected with ACP or the microcontroller 30. If someone opens the device 10, the tamper switch 25 will be pushed then the microcontroller 30 will send alarm signal to the ACP by the alarm output element 51 and the ACP will send siren signal to the microcontroller 30 by the siren input element 52. After the device 10 receives the siren input signal, the build-in high peak siren 531 will send audible warning messages and the LED matrix 532 will flash and send visual warning messages.

Figure 20:
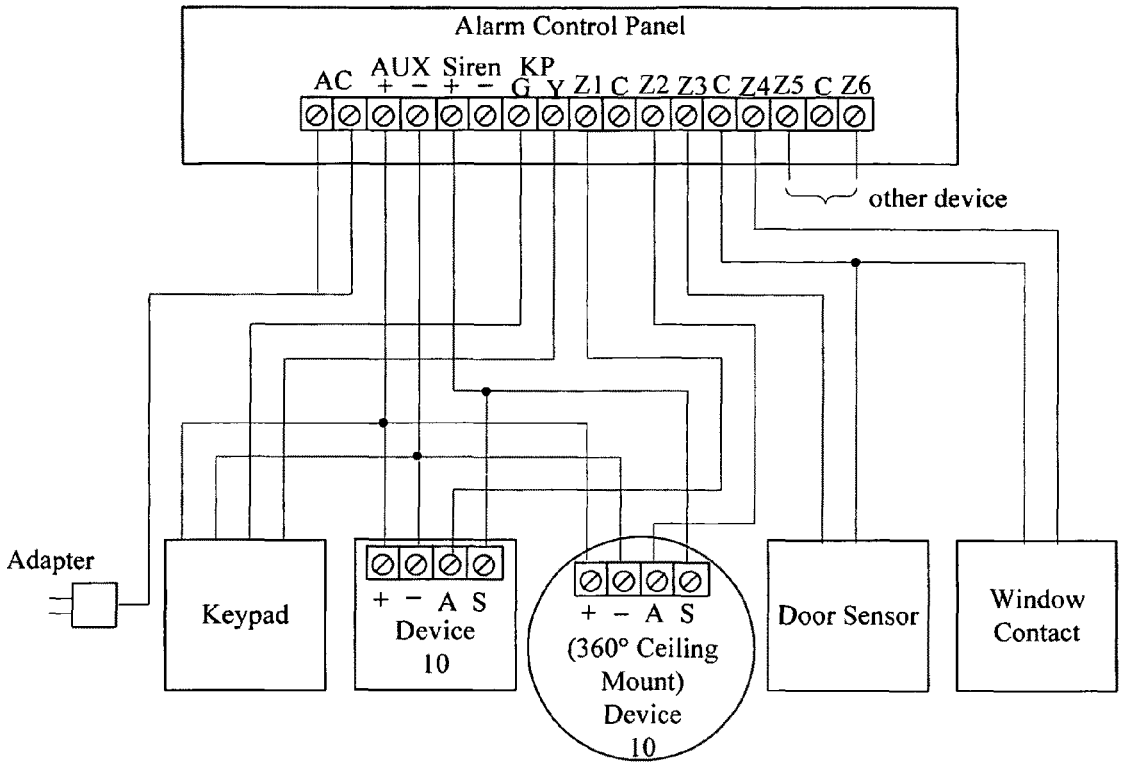
FIG. 20 is an illustration of an ACP setting with the device with motion detection, local alarm warning and supervisory function combined together for alarm system according to the above preferred embodiment of the present invention.

Referring to FIG. 20, an ACP setting with device with motion detection, local alarm warning and supervisory function combined together for alarm system is illustrated. Referring to FIGS. 21A and 21B, alarm systems equipped with the present invention in residential, commercial or industrial applications are illustrated. The multiple devices 10 form a local warning matrix network (LWMN) to increase the coverage of the alarm system. The multi-point alarm warning will bring a very scary effect to burglars/intruders who will lose intentions right away and will generate a confusing situation to burglars/intruders who may think there is a secondary/backup alarm system beside the one they have destroyed.

The multiple devices 10 form a neighbor-watch plan that brings high pressure and sharp scary to intruders who will lose intentions right away. When one of the device 10 detects motion and send alarm signal to ACP, then ACP will send siren signal to all devices. So the high peak build-in siren 531 and LED matrix 532 of all the devices will send warning messages. When the ACP is destroyed, then all devices 10 will send audible and visual warning messages by high peak sound and flashing to frighten away the intruders.

Figure 22:
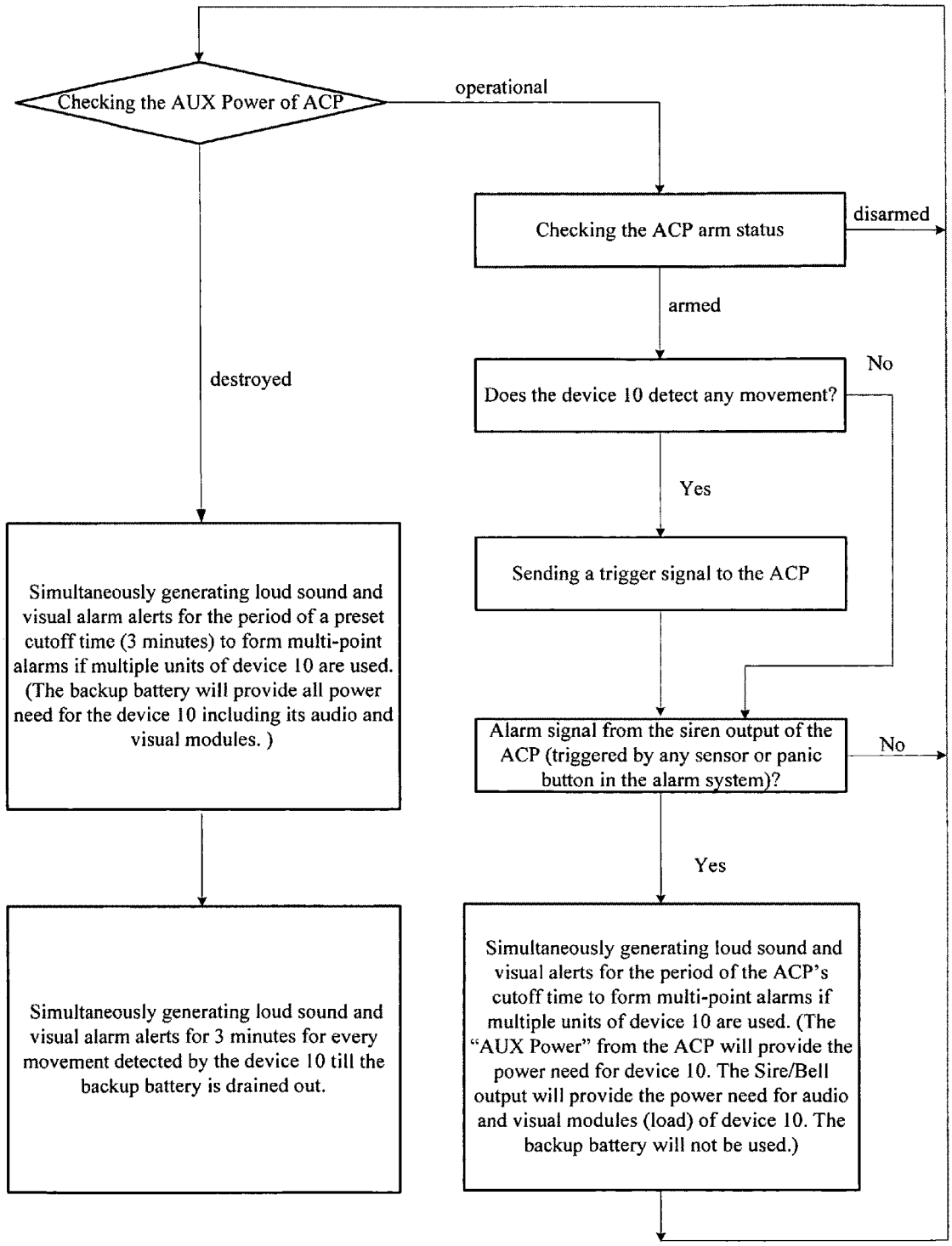
FIG. 22 is a logic flow chart of the device with motion detection, local alarm warning and supervisory function combined together for alarm system according to the above preferred embodiment of the present invention.

Referring to FIG. 22, the logic operation flow chart of the invented device applied in an alarm system comprises the following steps.

(A) check the AUX Power of ACP;

(B) If the ACP is destroyed, generate loud sound and visual alarm alerts simultaneously for the period of a preset cutoff time (such as 3 minutes) to form multi-point alarms if multiple units of device 10 are used. (The backup battery 30 will provide all power needed for the device 10 including its audio and visual modules.); and (C) generate loud sound and visual alarm alerts simultaneously for a preset time (such as 3 minutes) for every movement detected by the device 10 till the backup battery is drained out The step (A) further comprises steps:

(A1) If the ACP is operational, check the ACP arm status (A2) go back to step (A) if the ACP is in disarmed status; Check whether the device 10 detects any movement if the ACP is in armed status;

(A3) If the device 10 detects any movement, send a trigger signal to the ACP;

(A4) check siren signal from the siren output of the ACP (triggered by any sensor or panic button in the alarm system); If no siren signal, go back to step (A);

(A5) If a siren signal is received, generate loud sound and visual alerts simultaneously for the period of the ACP's cutoff time to form multi-point alarms if multiple units of device 10 are used. (The "AUX Power" from the ACP will provide the power need for device 10. The Sire/Bell output will provide the power need for audio and visual modules (load) of device 10. The backup battery will not be used.); and (A6) go back to step (A).

Figure 23:
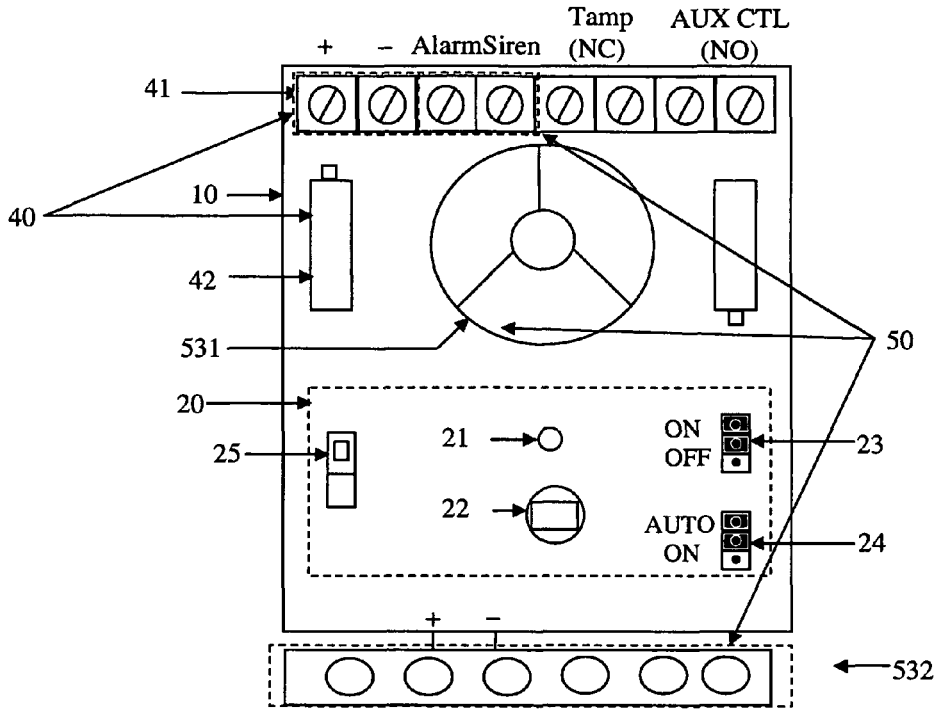
FIG. 23 is a front view illustration of the device with motion detection, local alarm warning and supervisory function combined together for alarm system according to another preferred embodiment of the present invention.

According to the present invention, in a second embodiment, referring to FIG. 23, the invented device with motion detection, local alarm warning and supervisory function combined together for alarm system comprises all same parts from the above preferred embodiment except a UL/European standard 6-wire terminal which substitutes the 4-wire terminal as shown in FIG. 1. The 6-wire terminal further includes six connections: +, –, Alarm, Siren, Tamp, and AUX control. The "+, –" connections connect with the "AUX power" connection of an ACP to receive power. The "Alarm" connection connects with the "ZONE" connection of an ACP to send alarm output signals to the ACP. The "Siren" connection connects with the "ZONE" connection of an ACP to receive siren signals from the ACP. The normally close "Tamp" connection and the normally open "AUX CTL" connection connect to the "ZONE" connections of an ACP.

Figure 24:
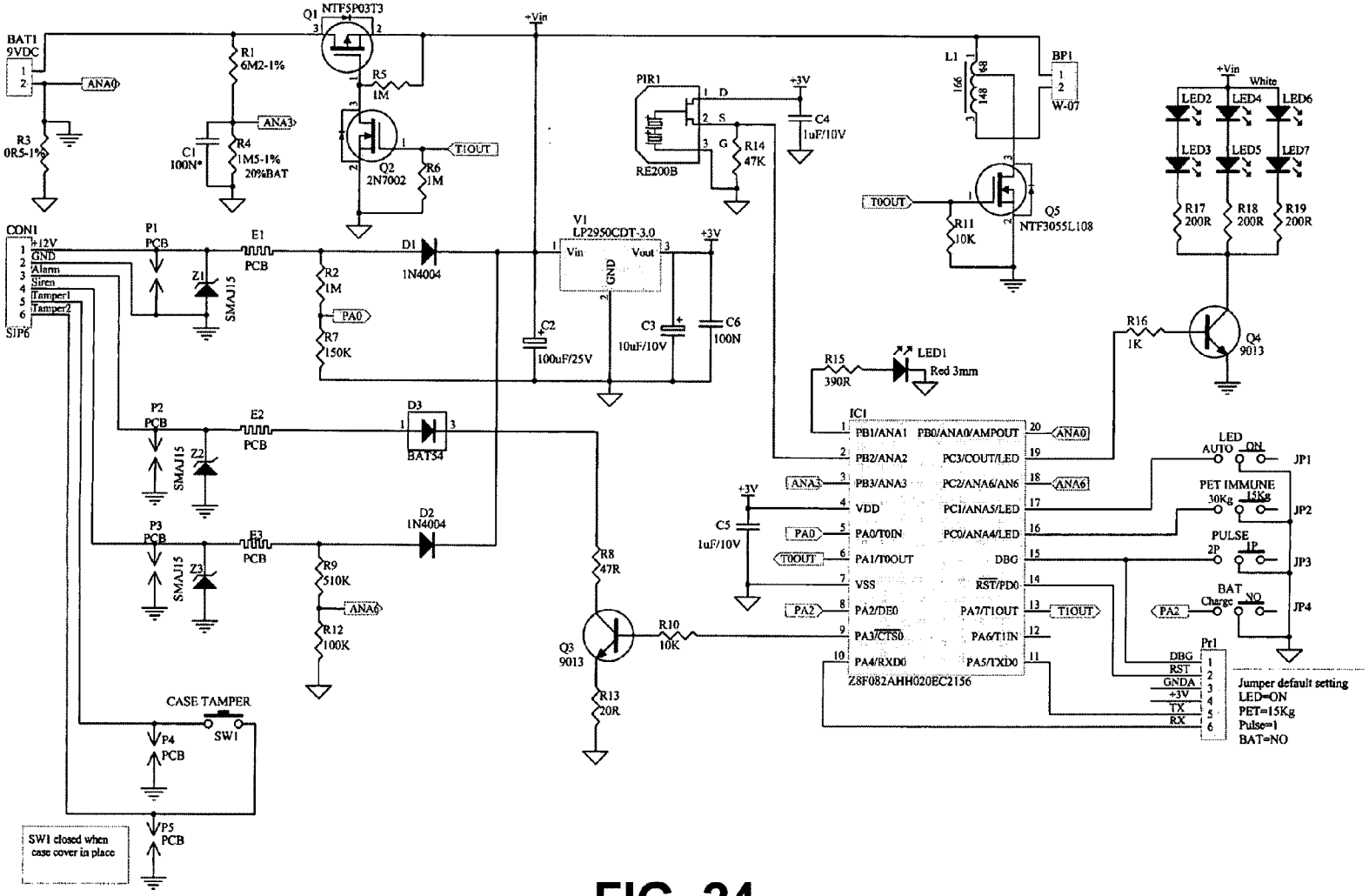
FIG. 24 is a circuit diagram of the device with motion detection, local alarm warning and supervisory function combined together for alarm system according to the above another preferred embodiment of the present invention.

Referring to FIG. 24, a circuit diagram of the invented device with motion detection, local alarm warning and supervisory function combined for alarm system is illustrated.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A device with single main control unit (MCU) based motion detection, local alarm and supervisory arrangement for alarm system controlled by an alarm control panel (ACP), comprising:

a sensor component monitoring environment of said alarm system to generate a reference information, wherein said sensor component comprises an energy sensor adapted for defining a detecting area and detecting energy directed within said detecting area to produce inputted energy signals;

an output component communicatively connected with said ACP which is adapted to generate warning messages;

a power supply component providing power for said device wherein further comprises an auxiliary (AUX) power supply provided by said ACP and a backup power supply providing power for said device when said ACP is not available; and a microcontroller communicatively connected with said sensor component for receiving said reference information therefrom and drive said output component according to said reference information, wherein said microcontroller monitors said ACP and enables said backup power supply when said ACP is not available, wherein said inputted energy signals from said energy sensor is processed by said microcontroller which comprises a means for converting said inputted energy signals into data samples, wherein a plurality of data samples are constructed to form a predetermined number of constructed sample window of constructed samples in time, wherein a control range is determined for each of said constructed sample windows, and thus by comparing said relationship between said successive constructed sample windows, said microcontroller is capable of determining whether there is an need to send alarm signals to said ACP.

2. The device, as recited in claim 1, wherein said energy sensor is a pyroelectric sensor which is a pyroelectric sensing element adapted for sensing energy radiation, wherein said infrared radiation as an input signal is converted into an output signal through a signal conversion module of said pyroelectric sensor, wherein said output signals generally contain real signals with low frequency and noise signals mixed therewith.

3. The device, as recited in claim 2, wherein said converting means of said microcontroller is an analog to digital converter (A/D converter) converting said output signals from said pyroelectric sensor to data samples for data processing.

4. The device, as recited in claim 3, wherein said sensor component further comprises a LED indicator to indicate that a motion is detected; a pet immunity jumper to set immunity weight range for pets; an auto LED jumper to enable and disable said LED indicator; and a tamper switch to detect if said device is been invaded.

5. The device, as recited in claim 4, wherein said microcontroller send alarm signal to said ACP while said ACP is in armed status.

6. The device, as recited in claim 5, wherein said LED indicator flashes when said microcontroller decides motion is detected.

7. The device, as recited in claim 6, wherein said auto LED jumper is set to disable said LED indicator to avoid disclosing detection profile when said microcontroller decides a motion is detected.

8. The device, as recited in claim 1, wherein said power supply component further comprises a power test point (APTP) communicatively connected with said microcontroller to monitor said power supply from said ACP, wherein when said microcontroller detects via said APTP that said AUX power supply is disconnected or lost, said microcontroller sends alarm signal to said ACP and enable said backup power supply to provide power to said device.

9. The device, as recited in claim 8, wherein said backup power supply is a battery, wherein said power supply component further comprises a low battery test point (LBTP) to monitor said backup power supply, wherein when said microcontroller detects via said LBTP that said capacity of said backup power supply is low, said microcontroller sends an alarm signal to said ACP to indicate low energy.

10. The device, as recited in claim 3, wherein said power supply component further comprises a power test point (APTP) communicatively connected with said microcontroller to monitor said power supply from said ACP, wherein when said microcontroller detects via said APTP that said AUX power supply is disconnected or lost, said microcontroller sends alarm signal to said ACP and enable said backup power supply to provide power to said device.

11. The device, as recited in claim 10, wherein said backup power supply is a battery, wherein said power supply component further comprises a low battery test point (LBTP) to monitor said backup power supply, wherein when said microcontroller detects via said LBTP that said capacity of said backup power supply is low, said microcontroller sends an alarm signal to said ACP to indicate low energy.

12. The device, as recited in claim 11, wherein said output component comprises an alarm output element which enables said microcontroller to send alarm signal to said ACP; a siren input element which enables said microcontroller to receive siren signals from said ACP; and an alarm warning element controlled by said microcontroller to send warning messages.

13. The device, as recited in claim 12, wherein said microcontroller controls said alarm warning element to send audible and visual warning messages.

14. The device, as recited in claim 13, wherein said alarm output element comprises a wireless alarm output transmitter module to send alarm signal to said ACP wirelessly.

15. The device, as recited in claim 14, wherein said siren input element comprises a wireless siren input receiver module to receive said siren signals from said ACP wirelessly.

16. The device, as recited in claim 3, wherein said output component comprises an alarm output element which enables said microcontroller to send alarm signal to said ACP; a siren input element which enables said microcontroller to receive siren signals from said ACP; and an alarm warning element controlled by said microcontroller to send warning messages.

17. The device, as recited in claim 16, wherein said microcontroller controls said alarm warning element to send audible and visual warning messages.

18. The device, as recited in claim 17, wherein said alarm output element comprises a wireless alarm output transmitter module to send alarm signal to said ACP wirelessly.

19. The device, as recited in claim 18, wherein said siren input element comprises a wireless siren input receiver module to receive said siren signals from said ACP wirelessly.

20. The device, as recited in claim 9, wherein said output component comprises an alarm output element which enables said microcontroller to send alarm signal to said ACP; a siren input element which enables said microcontroller to receive siren signals from said ACP; and an alarm warning element controlled by said microcontroller to send warning messages.

21. The device, as recited in claim 20, wherein said microcontroller controls said alarm warning element to send audible and visual warning messages.

22. The device, as recited in claim 21, wherein said alarm output element comprises a wireless alarm output transmitter module to send alarm signal to said ACP wirelessly.

23. The device, as recited in claim 22, wherein said siren input element comprises a wireless siren input receiver module to receive said siren signals from said ACP wirelessly.

24. An alarm system, comprising:

an alarm control panel (ACP); and a plurality of devices with single main control unit (MCU) based motion detection, local alarm and supervisory arrangement connecting with said ACP, wherein comprises:

a sensor component monitoring environment of said alarm system to generate a reference information, wherein said sensor component of said device comprises an energy sensor adapted for defining a detecting area and detecting energy directed therewithin to produce inputted energy signals;

an output component communicatively connected with said ACP which is adapted to generate warning messages;

a power supply component providing power for said device wherein further comprises an auxiliary (AUX) power supply provided by said ACP and a backup power supply providing power for said device when said ACP is not available; and a microcontroller communicatively connected with said sensor component for receiving said reference information therefrom and drive said output component according to said reference information, wherein said microcontroller monitors said ACP and enables said backup power supply when said ACP is not available, wherein said plurality of devices and said ACP form a local warning matrix network (LWMN), wherein when one of said devices detects motion and sends an alarm signal to said ACP, said ACP will send signal to all devices for alarming, wherein each device of said system works independently when said ACP is destroyed, wherein said inputted energy signals from said energy sensor is processed by said microcontroller which comprises a means for converting said inputted energy signals into data samples, wherein a plurality of data samples are constructed to form a predetermined number of constructed sample window of constructed samples in time, wherein a control range is determined for each of said constructed sample windows, and thus by comparing said relationship between said successive constructed sample windows, said microcontroller is capable of determining whether there is an need to send alarm signals to said ACP.

25. The system, as recited in claim 24, wherein said energy sensor is a pyroelectric sensor which is a pyroelectric sensing element adapted for sensing energy radiation, wherein said infrared radiation as an input signal is converted into an output signal through a signal conversion module of said pyroelectric sensor, wherein said output signals generally contain real signals with low frequency and noise signals mixed therewith.

26. The system, as recited in claim 25, wherein said converting means of said microcontroller is an analog to digital converter (A/D converter) converting said output signals from said pyroelectric sensor to data samples for data processing.

27. The system, as recited in claim 26, wherein said sensor component further comprises a LED indicator to indicate that a motion is detected; a pet immunity jumper to set immunity weight range for pets; an auto LED jumper to enable and disable said LED indicator; and a tamper switch to detect if said device is been invaded.

28. The system, as recited in claim 27, wherein said microcontroller send alarm signal to said ACP while said ACP is in armed status.

29. The system, as recited in claim 28, wherein said output component comprises an alarm output element which enables said microcontroller to send alarm signal to said ACP; a siren input element which enables said microcontroller to receive siren signals from said ACP; and an alarm warning element controlled by said microcontroller to send warning messages.

30. The system, as recited in claim 29, wherein said microcontroller controls said alarm warning element to send audible and visual warning messages.

31. The system, as recited in claim 30, wherein said alarm output element comprises a wireless alarm output transmitter module to send alarm signal to said ACP wirelessly.

32. The system, as recited in claim 31, wherein said siren input element comprises a wireless siren input receiver module to receive said siren signals from said ACP wirelessly.

33. A process for operating a device with single main control unit (MCU) based motion detection, local alarm and supervisory arrangement for alarm system controlled by an alarm control panel (ACP), comprising the steps of:

(a) defining a detecting area and detecting energy directed within said detecting area to produce inputted energy signals;

(b) checking an auxiliary (AUX) Power supply of said ACP;

(c) enabling a backup power supply to provide power;

(d) generating audio and/or video alarm alerts for a predetermined period of time if said ACP is destroyed; and (e) generating audio and/or video alarm alerts for a predetermined period of time when a motion is detected;

wherein the step (b) further comprises steps of:

(b1) checking said ACP's arm status if said ACP is operational;

(b2) checking if said device detects any movement;

(b3) sending a trigger signal to said ACP when said ACP is armed and a movement is detected;

(b4) checking a siren signal from a siren output of said ACP; and (b5) generating audio and/or video alarm alerts for a predetermined period of time if a siren signal is received;

wherein the step (a) further comprises the steps of:

(a1) converting said inputted energy signals into data samples;

(a2) constructing said data samples to form a predetermined number of constructed sample window of constructed samples in time, wherein a control range is determined for each of said constructed sample windows; and (a3) comparing a relationship between successive constructed sample windows of said constructed sample windows.

* * * * *